US010851572B1

(12) United States Patent
Flynn

(10) Patent No.: US 10,851,572 B1
(45) Date of Patent: Dec. 1, 2020

(54) HEIGHT COMPENSATING SLIDING FENESTRATION SYSTEMS AND METHODS

(71) Applicant: ANDERSEN CORPORATION, Bayport, MN (US)

(72) Inventor: John Scott Flynn, Temecula, CA (US)

(73) Assignee: ANDERSEN CORPORATION, Bayport, MN (US)

( * ) Notice: Subject to any disclaimer, the term of this patent is extended or adjusted under 35 U.S.C. 154(b) by 40 days.

(21) Appl. No.: 15/840,471

(22) Filed: Dec. 13, 2017

Related U.S. Application Data

(60) Provisional application No. 62/434,137, filed on Dec. 14, 2016.

(51) Int. Cl.

| | |
|---|---|
| ***E05D 13/00*** | (2006.01) |
| ***E05D 15/56*** | (2006.01) |
| ***E06B 3/46*** | (2006.01) |
| ***E06B 1/52*** | (2006.01) |
| ***E06B 3/52*** | (2006.01) |
| ***E05D 15/08*** | (2006.01) |
| ***E06B 7/22*** | (2006.01) |

(52) U.S. Cl.
CPC ..... *E05D 15/565* (2013.01); *E05D 15/08* (2013.01); *E06B 1/52* (2013.01); *E06B 3/4636* (2013.01); *E06B 3/52* (2013.01); *E06B 7/22* (2013.01); *E05Y 2900/132* (2013.01)

(58) Field of Classification Search
CPC . E05D 15/656; E05D 15/08; E05Y 2900/132; E06B 7/22; E06B 3/52; E06B 3/4636; E06B 1/52
USPC ..... 49/226, 234, 414, 422, 425, 452, 235
See application file for complete search history.

(56) References Cited

U.S. PATENT DOCUMENTS 1,448,845 A * 3/1923 Johnson ..... E06B 3/50 49/260
1,879,730 A * 9/1932 Browne ..... E05D 13/123 49/420
1,933,558 A * 11/1933 Klein ..... E06B 3/44 49/422
2,859,492 A * 11/1958 Nicoll, Jr. ..... E06B 3/4609 49/422
2,944,282 A * 7/1960 Greco ..... E04B 2/827 16/87 R
3,145,433 A * 8/1964 Jones ..... E06B 3/26347 49/414
3,168,355 A * 2/1965 Rudolph ..... E05D 15/0691 49/414
3,169,283 A * 2/1965 Gerulis ..... E06B 3/44 49/422
3,206,804 A * 9/1965 Perry ..... E06B 3/44 49/418
3,226,778 A * 1/1966 Kollsman ..... E04B 2/827 49/130

(Continued)

*Primary Examiner* — Jerry E Redman
(74) *Attorney, Agent, or Firm* — Mueting Raasch Group

(57) ABSTRACT

Sliding fenestration systems that compensate for changes in opening height after installation and methods of installing such sliding fenestration systems are described herein. The head track of a sliding fenestration system moves vertically relative to the bottom of the building opening to compensate for changes in building opening height while still maintaining lateral support for the panels in the sliding fenestration system by virtue of a direct connection between the head track and the top of the building opening.

25 Claims, 10 Drawing Sheets

(56) References Cited

U.S. PATENT DOCUMENTS 3,256,641 A * 6/1966 Johnson ..... E06B 3/44 49/419
3,397,487 A * 8/1968 Hunt ..... E06B 3/924 49/130
3,399,490 A * 9/1968 Hettinger ..... E06B 3/50 49/414
3,442,051 A * 5/1969 Johnson ..... E05D 15/0682 49/414
3,483,658 A * 12/1969 Dallaire ..... E06B 3/4681 49/419
3,583,101 A * 6/1971 Pudenz ..... E06B 3/4609 49/420
3,731,430 A * 5/1973 Dallaire ..... E06B 3/42 49/419
3,785,090 A * 1/1974 MacGillis ..... E05D 15/0665 49/425
3,859,754 A * 1/1975 Budich ..... E06B 3/44 49/425
3,869,839 A * 3/1975 Johnson ..... E06B 1/6069 52/204.69
4,020,595 A * 5/1977 Duncan ..... E06B 7/18 49/306
4,034,510 A * 7/1977 Huelsekopf ..... E05D 15/165 49/419
4,096,665 A * 6/1978 Ellingson, Jr. ..... E06B 3/44 49/414
4,112,622 A * 9/1978 Stewart ..... E05D 15/066 16/91
4,237,664 A 12/1980 Wilmes
4,333,283 A * 6/1982 Ebata ..... E06B 3/2605 49/504
4,726,148 A * 2/1988 Tix ..... E06B 3/44 49/414
4,850,145 A * 7/1989 McAfee ..... E05D 15/0669 49/501
4,916,863 A * 4/1990 Burrous ..... E06B 3/44 49/419
4,993,188 A * 2/1991 Erickson ..... E06B 3/44 49/419
5,199,219 A * 4/1993 Martini ..... E05D 15/18 49/414
5,274,955 A * 1/1994 Dallaire ..... E06B 3/44 49/406
5,280,686 A * 1/1994 Davies ..... E05B 65/0864 49/209
5,544,450 A * 8/1996 Schmidt ..... E05D 13/08 49/419
5,699,636 A * 12/1997 Stark ..... E06B 1/62 49/414
5,845,363 A * 12/1998 Brempell ..... E05D 15/0669 16/105
5,860,189 A * 1/1999 An ..... E05D 15/0669 16/105
6,122,864 A * 9/2000 Martin ..... E06B 7/23 49/428
6,381,911 B1 5/2002 Weiland
6,792,651 B2 9/2004 Weiland et al.
7,024,820 B1 * 4/2006 Dustin ..... E06B 9/52 160/105
7,861,761 B2 * 1/2011 Martineau ..... E06B 9/54 160/273.1
7,971,392 B2 * 7/2011 Seo ..... E05D 15/565 49/209
8,240,089 B2 * 8/2012 Lambertini ..... E05D 15/565 49/425
8,281,519 B2 * 10/2012 Lambertini ..... E05C 9/24 49/209
8,381,445 B2 2/2013 Hans
8,533,997 B2 * 9/2013 Stoutenborough ..... E05B 5/00 292/336.3
8,683,747 B2 * 4/2014 Kim ..... E06B 1/04 49/404
9,217,277 B2 12/2015 Hans
9,458,656 B2 * 10/2016 Mickelson ..... E05D 15/565
9,512,656 B2 * 12/2016 Lee ..... E05D 15/0665
2004/0163317 A1 * 8/2004 Reich ..... E05D 15/565 49/209
2005/0246962 A1 * 11/2005 Jacobs ..... E05D 15/0691 49/425
2007/0062122 A1 * 3/2007 Polus ..... E05D 15/0669 49/425
2008/0190030 A1 * 8/2008 Cheon ..... E05D 15/0665 49/425
2009/0038228 A1 * 2/2009 Lee ..... E05D 15/1042 49/360
2009/0282742 A1 * 11/2009 Therrien ..... E05D 15/0621 49/425
2011/0219694 A1 * 9/2011 Hasin ..... E05D 15/10 49/226
2012/0005964 A1 * 1/2012 Isaacs ..... E05D 15/066 49/452
2014/0041304 A1 * 2/2014 Martin ..... E05D 15/0626 49/352
2015/0052819 A1 * 2/2015 Lee ..... E06B 3/4627 49/420

* cited by examiner

HEIGHT COMPENSATING SLIDING FENESTRATION SYSTEMS AND METHODS

RELATED APPLICATION

This application claims the benefit under 35 U.S.C. Section 119 of U.S. Provisional Patent Application Ser. No. 62/434,137 entitled "HEIGHT COMPENSATING SLIDING FENESTRATION SYSTEMS AND METHODS" and filed on Dec. 14, 2016, which is incorporated herein by reference in its entirety.

This invention relates generally to sliding fenestration systems with one or more sliding panels and methods of installing the sliding fenestration systems. The sliding fenestration systems compensate for changes in opening height after installation.

Fenestration systems including one or more sliding panels supported on a sill are used for opening and closing openings in building structures. Some fenestration systems that include only one sliding panel and have a raised sill on which the sliding panel is supported may be referred to as patio doors, sliding doors, gliding doors, etc., although some sliding fenestration systems may include window units having one or more sliding panels supported on a sill. Fenestration systems that include two or more sliding panels supported on a sill are sometimes referred to as multislide fenestration systems. Another variation of sliding fenestration systems includes liftslide fenestration systems in which one or more sliding panels are raised (i.e., lifted) from a sill onto rollers or carriages for movement between their open and closed positions and then lowered in place. Sliding panels in liftslide systems may provide advantages when lowered in their closed positions due to potential improvements in sealing to limit the passage of air and/or water around the sliding panels. In wider openings that require more than one sliding panel to close an opening, the sliding panels commonly slide past one another to form a stack of sliding panels to reduce the space needed to store the sliding panels in the open position.

Examples of some sliding fenestration systems (and/or components of such systems) may be described in, e.g., U.S. Pat. Nos. 4,237,664; 6,381,911; 6,792,651; 7,971,392; 8,240,089; 8,381,445; 9,217,277; and 9,458,656.

SUMMARY

Sliding fenestration systems that compensate for changes in opening height after installation and methods of installing such sliding fenestration systems are described herein.

Although opening heights in building openings in which sliding fenestration systems have been traditionally placed are known to change somewhat (due to, e.g., thermal expansion and contraction, building shifting/settling, etc.), attempts to compensate for changes in opening height have been focused on providing a frame including a head track that is fixedly attached to vertical side jambs such that the frame height at the side jambs remains constant regardless of changes in the height of the building opening. In some sliding fenestration systems, changes in the building opening height are addressed by locating the head track of the frame in a compensation channel that is attached to the top of the building opening in which the fenestration system is installed. One example of such a construction is depicted in, e.g., FIGS. 1-3, where a frame 100 of a sliding fenestration system includes a sill 102, a pair of vertical side jambs 104 and a head track 110 located in a compensation channel 106 extending between the vertical side jambs 104.

For reference, each of the figures includes Cartesian coordinate system axes, where the x-axis is aligned with the width of the building opening, which is also the direction along which the panels of the sliding fenestration systems move during opening and closing, the y-axis is aligned with the direction along which lateral loads exerted on the panels (by wind, etc.) act, and z-axis is aligned with the height of the building opening.

The cross-sectional view of the compensation channel 106 as seen in, e.g., FIG. 2 depicts the compensation channel 106 attached to the top of the building opening 10 with the head track 110 of the frame 100 located within the compensation channel 106 for movement towards and away from the top of the building opening 10 along the vertical axis 101 as indicated by the bidirectional arrow in FIG. 2. As noted above, the head track 110 is fixedly attached to the vertical side jamb 104 such that the location of the head track 110 relative to the vertical side jamb 104 does not change as the head track 110 and the compensation channel 106 move independently of each other.

This approach is further illustrated in FIG. 3, where head track 110 is depicted as being attached to vertical side jamb 104 at junction 105. As discussed herein, the head track 110 is fixedly attached to the side jamb 104 at junction 105 such that the location of the end of head track 110 on vertical side jamb 104 does not change as the height of the building opening changes.

Enclosing large open areas in multistory buildings (such as, e.g., luxury condominiums) with sliding fenestration systems can, however, present additional problems not encountered when the sliding fenestration systems are used in, e.g., single story structures and/or narrower openings. In particular, the wider openings of such buildings into which the doors are installed may exhibit variations in height that could, in one or more embodiments, exceed the designed capabilities of the compensation channels used in the known sliding fenestration systems. As a result, connections between the head tracks and the compensation channels containing them may be compromised which can, in turn, compromise the support provided against lateral loads placed on the panel(s) by, e.g., wind, etc.

These issues may become more acute in wider building openings as found in some more recent buildings, where it may be desired to install sliding fenestration systems into building openings having unsupported widths that may reach 50 feet or more. One example of building structures that may provide opportunities for wide, unsupported building openings includes buildings constructed of horizontal concrete panels supported by concrete columns. The horizontal panels may, e.g., be made of reinforced concrete. While the horizontal panels are quite rigid and robust, a certain amount of flexing is possible, due at least in part to the size and placement of loads on the floor above. Such flexing can produce changes in the opening height, with some building specifications allowing for changes in opening height of as much as, e.g., ±1.25" over the width of the opening. Although this amount of height deviation is small considering the width of the span, it can significantly hamper the operation of sliding fenestration systems installed in such openings.

Changes in the height of wider, unsupported openings may occur in response to loads placed within the width of the opening above the opening and/or on the same floor as the opening. In some instances, opening height may change even when a load is placed outside of the width of the opening, e.g., on the opposite side of a support column, for example.

These concepts are at least partially illustrated in FIG. 4 in which a portion of a multistory building structure is depicted. Horizontal panels 10*a*, 10*b*, 10*c*, 10*d*, 10*e*, and 10*f* are supported by vertical columns 12*a*-12*f* and define building openings 11, each of which has an opening height H. A downward load on horizontal panel 10*a*, for example, may, in one or more embodiments, cause the horizontal panel 10*a* to sag an amount s, producing lowered ceiling profile as illustrated by broken line 13. If, at the same time, a load is placed on horizontal panel 10*e* (and assuming that horizontal panels 10*b* and 10*e* are integrally coupled with each other), horizontal panel 10 the may sag as illustrated by broken line 17 causing horizontal panel 10*b* to rise as illustrated by broken line 15 by an amount r. The sag in horizontal panel 10*a*, when combined with the rise in horizontal panel 10*b*, may reduce the opening height of building opening 11 between columns 12*a* and 12*b* by an amount s+r.

Although the approach taken by known sliding fenestration systems in which a compensation channel (that moves with the top of the building opening) contains a head track having a fixed height relative to side jambs supporting it may be useful in smaller openings, one potential problem associated with such constructions may be the limited ability of the compensation channel to support lateral loads, thus inhibiting the opening and the space within which the sliding fenestration system operates freely—particularly when the sliding fenestration systems occupy wider and wider openings. The height compensating sliding fenestration systems described herein, however, provide a head track that can be directly attached to the top of a building opening to offer improved lateral support to the panels in the sliding fenestration systems described herein.

In sum, the head track is configured to move vertically relative to the vertical side jambs to compensate for changes in building opening height while still maintaining lateral support for the panels in the sliding fenestration system by virtue of the direct connection between the head track and the top of the building opening.

The sliding fenestration systems described herein are configured for installation in a building opening that includes a bottom, first and second sides, and a top, wherein the bottom extends between the first and second sides at the bottom of the building opening, and wherein the top extends between the first and second sides at the top of the building opening. In one or more embodiments, the sliding fenestration systems include: a head track extending from a first end to a second end, the head track configured for attachment to the top of building opening between the first and second sides of the building opening, wherein the first and second ends of the head track are configured to move towards and away from the bottom of the building opening with the top of the building opening, wherein the head track comprises a guide rail projecting downward away from the top of the building opening, and wherein the guide rail comprises an inner guide rail surface and an outer guide rail surface located on an opposite side of the guide rail from the inner guide rail surface; a sliding panel configured for sliding movement between the first end and the second end of the head track along a direction defined by the guide rail of the head track, wherein the sliding panel comprises a frame that comprises a first stile, a second stile, a bottom rail, and a top rail, wherein the top rail extends between a top end of the first stile and a top end of the second stile, and wherein the bottom rail extends between a bottom end of the first stile and a bottom end of the second stile; and a guide channel in the top rail of the sliding panel, wherein the guide channel comprises an inner channel surface and an outer channel surface, wherein the inner channel surface faces the outer channel surface across the guide channel, wherein at least a portion of the guide rail of the head track is located in the guide channel when the sliding panel is assembled with the head track in the building opening, and wherein the inner channel surface faces the inner guide rail surface and the outer channel surface faces the outer guide rail surface.

In one or more embodiments of the fenestration systems described herein, the fenestration system further comprises a guide channel seal assembly located in the guide channel between the guide rail and the guide channel, wherein the guide channel seal assembly forms a seal in the guide channel.

In one or more embodiments of the fenestration systems described herein, system further comprises: a lift mechanism operably connected to the sliding panel, wherein the lift mechanism is configured to raise the sliding panel from a lowered configuration to a raised configuration, wherein the top rail of the sliding panel moves towards the head track when moving from the lowered configuration to the raised configuration; and a guide channel seal assembly located in the guide channel between the guide rail and the guide channel, wherein the guide channel seal assembly forms a seal in the guide channel when the sliding panel is in both the raised and lowered configurations.

In one or more embodiments of the fenestration systems described herein, the guide channel seal assembly comprises an inner seal between the inner guide rail surface and the inner channel surface. In one or more embodiments, the inner seal comprises an inner seal member attached to the inner channel surface of the sliding panel, wherein the inner seal member is in sealing contact with the inner guide rail surface.

In one or more embodiments of the fenestration systems described herein, a guide channel seal assembly comprises an outer seal between the outer guide rail surface and the outer channel surface. In one or more embodiments, the outer seal comprises an outer seal member attached to the outer channel surface of the sliding panel, wherein the outer seal member is in sealing contact with the outer guide rail surface.

In one or more embodiments of the fenestration systems described herein, the sliding panel further comprises a first sliding seal assembly attached to the first stile proximate the top rail of the sliding panel, wherein the first sliding seal assembly comprises a sliding guide and a biasing member operably connected to the sliding guiding, wherein the biasing member is configured to bias the sliding guide against the guide rail of the head track, and wherein the sliding guide is movable along the first stile such that the sliding guide maintains contact with the guide rail of the head track as a distance between the top rail of the sliding panel and the head track changes. In one or more embodiments, the sliding guide comprises a U-shaped bearing end comprising a base and a pair of legs, wherein U-shaped bearing end receives a portion of the guide rail between the pair of legs when the base is in contact with the guide rail. In one or more embodiments, an inner leg of the pair of legs is positioned along the inner guide rail surface and an outer leg of the pair of legs is positioned along the outer guide rail surface. In one or more embodiments, the U-shaped bearing end is aligned with the guide channel in the top rail of the sliding panel when the sliding panel is assembled with the head track in the building opening such that at least a portion of the guide rail of the head track is located in the guide channel. In one or more embodiments, the base of the U-shaped bearing end of the sliding guide comprises an arcuate surface configured to contact the guide rail along a contact line oriented transverse to a length of the top rail of the sliding panel between the first and second stiles.

In one or more embodiments of the fenestration systems described herein, the sliding panel is movable along the guide rail of the head track into and out of a closed position, wherein the sliding guide of the first sliding seal assembly is aligned with a guide rail seal attached to the guide rail when the sliding panel is in the closed position, wherein the sliding guide and the guide rail seal form a seal when aligned with each other.

In one or more embodiments of the fenestration systems described herein, the sliding panel further comprises a second sliding seal assembly attached to the second stile proximate the top rail of the sliding panel, wherein the second sliding seal assembly comprises a second sliding guide and a second biasing member operably connected to the second sliding guiding, wherein the second biasing member is configured to bias the second sliding guide against the guide rail of the head track, and wherein the second sliding guide is movable along the second stile such that the second sliding guide maintains contact with the guide rail of the head track as a distance between the top rail of the sliding panel and the head track changes. In one or more embodiments, the second sliding guide of the second sliding seal assembly comprises a U-shaped bearing end comprising a base and a pair of legs, wherein U-shaped bearing end of the second sliding guide receives a portion of the guide rail between the legs when the base is in contact with the guide rail. In one or more embodiments, an inner leg of the pair of legs of the second sliding guide is positioned along the inner guide rail surface and an outer leg of the pair of legs of the second sliding guide is positioned along the outer guide rail surface. In one or more embodiments, the U-shaped bearing end of the second sliding guide is aligned with the guide channel in the top rail of the sliding panel when the sliding panel is assembled with the head track in the building opening such that at least a portion of the guide rail of the head track located in the guide channel. In one or more embodiments, the base of the U-shaped bearing end of the second sliding guide comprises an arcuate surface configured to contact the guide rail along a contact line oriented transverse to a length of the top rail of the sliding panel between the first and second stiles.

In one or more embodiments of the fenestration systems described herein, the sliding panel is movable along the guide rail of the head track into and out of a closed position, wherein the second sliding guide of the second sliding seal assembly is aligned with a second guide rail seal attached to the guide rail when the sliding panel is in the closed position, wherein the second sliding guide and the second guide rail seal form a second seal when aligned with each other.

In one or more embodiments of the fenestration systems described herein, the fenestration system further comprises a first side jamb comprising a top end and a bottom end, wherein the first end of the head track is located closer to the top end of the first side jamb than the bottom end of the first side jamb when the head track is positioned along the top of the building opening and the first side jamb is positioned along the first side of the building opening, and wherein the first end of the head track is configured to move along the first side jamb along a first axis extending between the top and bottom ends of the first side jamb.

In one or more embodiments of the fenestration systems described herein that include a first side jamb, the fenestration system comprises a first head track slide assembly proximate a junction of the first end of the head track and the first side jamb, wherein first head track slide assembly forms a first head track end seal between the first end of the head track and the first side jamb as the first end of the head track moves along the first axis. In one or more embodiments, the first head track slide assembly comprises a first slide block at the first end of the head track, wherein the first slide block moves within a first alignment channel in the first side jamb as the first end of the head track moves along the first axis. In one or more embodiments, the first slide block is aligned with the guide rail at the first end of the head track.

In one or more embodiments of the fenestration systems described herein that include a first side jamb, the fenestration system comprises: a second side jamb comprising a top end and a bottom end, wherein the second end of the head track is located closer to the top end of the second side jamb than the bottom end of the second side jamb when the head track is positioned along the top of the building opening and the second side jamb is positioned along the second side of the building opening, and wherein the second end of the head track is configured to move along a second axis extending along the second side jamb between the top and bottom ends of the second side jamb when the head track is attached to the header of the building opening and the second side jamb is attached to the second side of the building opening; and a second head track slide assembly proximate a junction of the second end of the head track and the second side jamb, wherein second head track slide assembly forms a second head track end seal between the second end of the head track and the second side jamb as the second end of the head track moves along the second axis. In one or more embodiments, the second head track slide assembly comprises a second slide block at the second end of the head track, wherein the second slide block moves within a second alignment channel in the second side jamb as the second end of the head track moves along the second axis. In one or more embodiments, the second slide block is aligned with the guide rail at the second end of the head track.

In one or more embodiments of the fenestration systems described herein, the fenestration system comprises: a second guide rail projecting downward away from the header of the building opening, wherein the second guide rail comprises an inner guide rail surface and an outer guide rail surface located on an opposite side of the guide rail from the inner guide rail surface, wherein the second guide rail is aligned with the guide rail; a second sliding panel configured for sliding movement between the first end and the second end of the head track along a direction defined by the second guide rail of the head track, wherein the second sliding panel comprises a frame that comprises a first stile, a second stile, a bottom rail, and a top rail, wherein the top rail of the second sliding panel extends between a top end of the first stile and a top end of the second stile, and wherein the bottom rail of the second sliding panel extends between a bottom end of the first stile and a bottom end of the second stile; and a guide channel in the top rail of the second sliding panel, wherein the guide channel of the second sliding panel comprises an inner channel surface and an outer channel surface, wherein the inner channel surface faces the outer channel surface across the guide channel of the second sliding panel, wherein at least a portion of the second guide rail of the head track is located in the guide channel of the second sliding panel when the second sliding panel is assembled with the head track in the building opening, and wherein the inner channel surface of the second sliding panel faces the inner guide rail surface of the second guide rail and the outer channel surface of the second sliding panel faces the outer guide rail surface of the second guide rail.

In one or more embodiments of the fenestration systems described herein including a second guide rail and a second sliding panel, the fenestration system further comprises a second guide channel seal assembly located in the guide channel of the second sliding panel between the guide channel of the second sliding panel and the second guide rail, wherein the second guide channel seal assembly forms a seal in the guide channel of the second sliding panel. In one or more embodiments of the fenestration systems described herein including a second guide rail and a second sliding panel, the system further includes: a second lift mechanism operably connected to the second sliding panel, wherein the second lift mechanism is configured to raise the second sliding panel from a lowered configuration to a raised configuration, wherein the top rail of the second sliding panel moves towards the head track when moving from the lowered configuration to the raised configuration; and a second guide channel seal assembly located in the guide channel of the second sliding panel between the second guide rail and the guide channel, wherein the second guide channel seal assembly forms a seal in the guide channel of the second sliding panel when the second sliding panel is in both the raised and lowered configurations.

In one or more embodiments of the fenestration systems described herein including a second guide rail and a second sliding panel, the second guide channel seal assembly comprises an inner seal between the inner guide rail surface of the second guide rail and the inner channel surface of the second sliding panel.

In one or more embodiments of the fenestration systems described herein including a second guide rail and a second sliding panel, the second guide channel seal assembly comprises an outer seal between the outer guide rail surface of the second guide rail and the outer channel surface of the second sliding panel. In one or more embodiments, the outer seal of the second guide channel seal assembly comprises an outer seal member attached to the outer channel surface of the second sliding panel, wherein the outer seal member is in sealing contact with the outer guide rail surface of the second guide rail.

In one or more embodiments of the fenestration systems described herein including a second guide rail and a second sliding panel, the second sliding panel further comprises a first sliding seal assembly attached to the first stile proximate the top rail of the second sliding panel, wherein the first sliding seal assembly comprises a sliding guide and a biasing member operably connected to the sliding guiding, wherein the biasing member is configured to bias the sliding guide against the second guide rail of the head track, and wherein the sliding guide is movable along the first stile of the second sliding panel such that the sliding guide maintains contact with the second guide rail of the head track as a distance between the top rail of the second sliding panel and the head track changes. In one or more embodiments, the sliding guide of the second sliding panel comprises a U-shaped bearing end comprising a base and a pair of legs, wherein U-shaped bearing end receives a portion of the second guide rail between the pair of legs when the base is in contact with the second guide rail. In one or more embodiments, the inner leg of the pair of legs of the first sliding seal assembly of the second sliding panel is positioned along the inner guide rail surface of the second guide rail and an outer leg of the pair of legs of the first sliding seal assembly of the second sliding panel is positioned along the outer guide rail surface of the second guide rail. In one or more embodiments, the U-shaped bearing end of the first sliding seal assembly of the second sliding panel is aligned with the guide channel in the top rail of the second sliding panel when the second sliding panel is assembled with the head track in the building opening such that at least a portion of the second guide rail of the head track is located in the guide channel of the second sliding panel. In one or more embodiments, the base of the U-shaped bearing end of the sliding guide of the first sliding seal assembly of the second sliding panel comprises an arcuate surface configured to contact the second guide rail along a contact line oriented transverse to a length of the top rail of the second sliding panel between the first and second stiles.

In one or more embodiments of the fenestration systems described herein including a second guide rail and a second sliding panel, the second sliding panel is movable along the second guide rail of the head track into and out of a closed position, wherein the sliding guide of the first sliding seal assembly of the second sliding panel is aligned with a third guide rail seal attached to the second guide rail when the second sliding panel is in the closed position, wherein the sliding guide of the first sliding seal assembly of the second sliding panel and the third guide rail seal form a third seal when aligned with each other.

In one or more embodiments of the fenestration systems described herein including a second guide rail and a second sliding panel, the second sliding panel further comprises a second sliding seal assembly attached to the second stile proximate the top rail of the second sliding panel, wherein the second sliding seal assembly comprises a second sliding guide and a second biasing member operably connected to the second sliding guiding, wherein the second biasing member is configured to bias the second sliding guide against the second guide rail of the head track, and wherein the second sliding guide is movable along the second stile of the second sliding panel such that the second sliding guide maintains contact with the second guide rail of the head track as a distance between the top rail of the second sliding panel and the head track changes. In one or more embodiments, the second sliding guide of the second sliding seal assembly of the second sliding panel comprises a U-shaped bearing end comprising a base and a pair of legs, wherein U-shaped bearing end of the receives a portion of the second guide rail between the pair of legs when the base is in contact with the second guide rail. In one or more embodiments, an inner leg of the pair of legs of the second sliding guide of the second sliding panel is positioned along the inner guide rail surface of the second guide rail and an outer leg of the pair of legs of the second sliding guide is positioned along the outer guide rail surface of the second guide rail. In one or more embodiments, the U-shaped bearing end of the second sliding guide is aligned with the guide channel in the top rail of the second sliding panel when the second sliding panel is assembled with the head track in the building opening such that at least a portion of the second guide rail of the head track is located in the guide channel of the second sliding panel. In one or more embodiments, the base of the U-shaped bearing end of the second sliding guide of the second sliding seal assembly of the second sliding panel comprises an arcuate surface configured to contact the second guide rail along a contact line oriented transverse to a length of the top rail of the second sliding panel between the first and second stiles of the second sliding panel.

In one or more embodiments of the fenestration systems described herein including a second guide rail and a second sliding panel, the second sliding panel is movable along the second guide rail of the head track into and out of a closed position, wherein the second sliding guide of the second sliding seal assembly of the second sliding panel is aligned with a fourth guide rail seal attached to the second guide rail when the second sliding panel is in the closed position, wherein the second sliding guide of the second sliding panel and the fourth guide rail seal form a fourth seal when aligned with each other.

Methods of installing a sliding fenestration system in a building opening that includes a bottom, first and second sides, and a top, wherein the bottom extends between the first and second sides at the bottom of the building opening, and wherein the top extends between the first and second sides at the top of the building opening are described herein. In one or more embodiments, the method comprises: attaching a head track to the top of the building opening between the first and second sides, wherein the head track extends from a first end proximate the first side to a second end proximate the second side, wherein movement of the top of the building opening relative to the bottom of the building opening moves the first end of the head track towards or away from the bottom of the building opening along a first axis aligned with the first side of the building opening, wherein movement of the top of the building opening relative to the bottom of the building opening moves the second end of the head track towards or away from the bottom of the building opening along a second axis aligned with the second side of the building opening; and positioning a sliding panel in the building opening such that at least a portion of a guide rail is located in a guide channel in a top rail of the sliding panel, wherein guide rail projects downward from the head track and the top of the building opening, and wherein movement of the sliding panel between the first and second sides of the building opening moves the guide channel along the guide rail.

In one or more embodiments of the methods described herein, the method further comprises forming the seal in the guide channel when the sliding panel is moving between the first and second sides of the building opening.

In one or more embodiments of the methods described herein, the sliding panel is movable between a lowered configuration and a raised configuration, wherein the top rail of the sliding panel moves towards the head track when moving the sliding panel from the lowered configuration to the raised configuration, wherein the method further comprises forming a seal in the guide channel when the sliding panel is in both the raised and lowered configurations and when the sliding panel is moving between the first and second sides of the building opening.

In one or more embodiments of the methods described herein, the sliding panel further comprises a sliding seal assembly positioned at an end of the guide channel, wherein a sliding guide of the sliding seal assembly is biased upwards against the guide rail of the head track such that the sliding guide maintains contact with the guide rail of the head track as a distance between the top rail of the sliding panel and the head track changes. In one or more embodiments, the sliding guide comprises a U-shaped bearing end comprising a base and a pair of legs, wherein U-shaped bearing end receives a portion of the guide rail between the pair of legs when the base is in contact with the guide rail.

In one or more embodiments of the methods described herein, the sliding panel is movable along the guide rail of the head track into and out of a closed position, wherein the sliding guide of the sliding seal assembly is aligned with a guide rail seal attached to the guide rail when the sliding panel is in the closed position, wherein the sliding guide and the guide rail seal form a seal when aligned with each other.

Where used herein, the terms "top" and "bottom" are used for reference relative to each other when the sliding fenestration systems and methods described herein are properly installed in a building opening.

Where used herein, the terms "exterior" and "interior" are used in a relative sense, e.g., an exterior side and an interior side of a sliding fenestration system and any of its components describe opposite sides of the sliding fenestration system and any of its components. In other words, an exterior side could be found within the interior of a building or other structure that would conventionally define an interior and an exterior, while an interior side could be found outside of a building or other structure that would conventionally define an interior and an exterior. With respect to the illustrative embodiments described herein, the exterior and interior sides of the sliding fenestration systems and any components thereof would be found on opposite sides along the y-axis of the Cartesian coordinate systems provided in the figures.

The above summary is not intended to describe each embodiment or every implementation of the sliding fenestration systems and/or methods as described herein. Rather, a more complete understanding of the invention will become apparent and appreciated by reference to the following Description of Illustrative Embodiment and claims in view of the accompanying figures of the drawing.

BRIEF DESCRIPTIONS OF THE DRAWING

DETAILED DESCRIPTION

Figure 1:
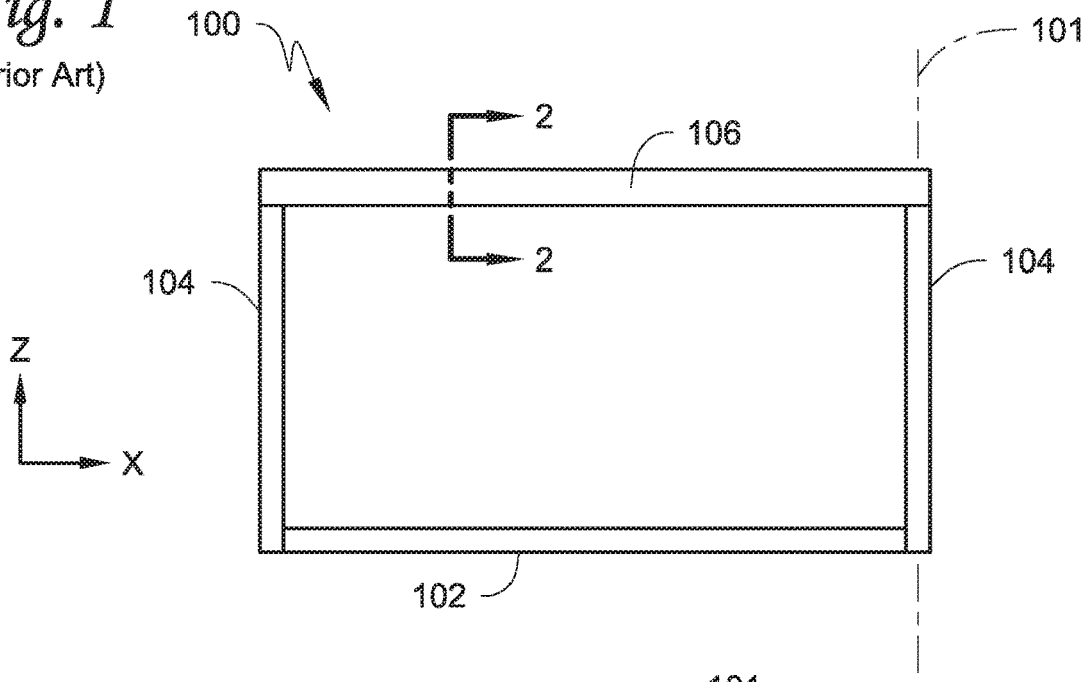
Fig. 1 (Prior Art)
FIG. 1 depicts one embodiment of a prior art sliding fenestration system frame.
Figure 2:
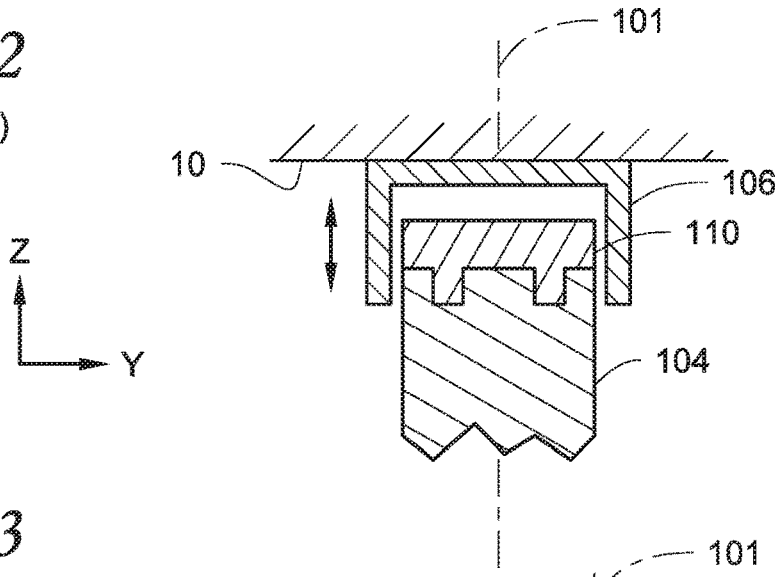
Fig. 2 (Prior Art)
FIG. 2 is an enlarged cross-sectional view of the sliding fenestration system frame of FIG. 1 taken along line 2-2 in FIG. 1.
Figure 3:
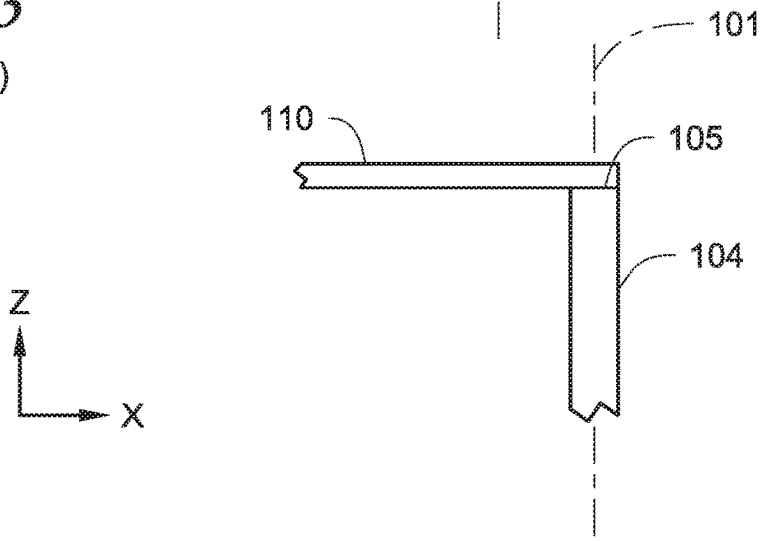
Fig. 3 (Prior Art)
FIG. 3 is an enlarged view of a junction between a head track and a vertical side jamb in the prior art sliding fenestration system frame depicted in FIG. 1.

In the following description, reference is made to the accompanying figures of the drawing which form a part hereof, and in which are shown, by way of illustration, specific embodiments. It is to be understood that other embodiments may be utilized and changes may be made without departing from the scope of the present invention.

Figure 5:
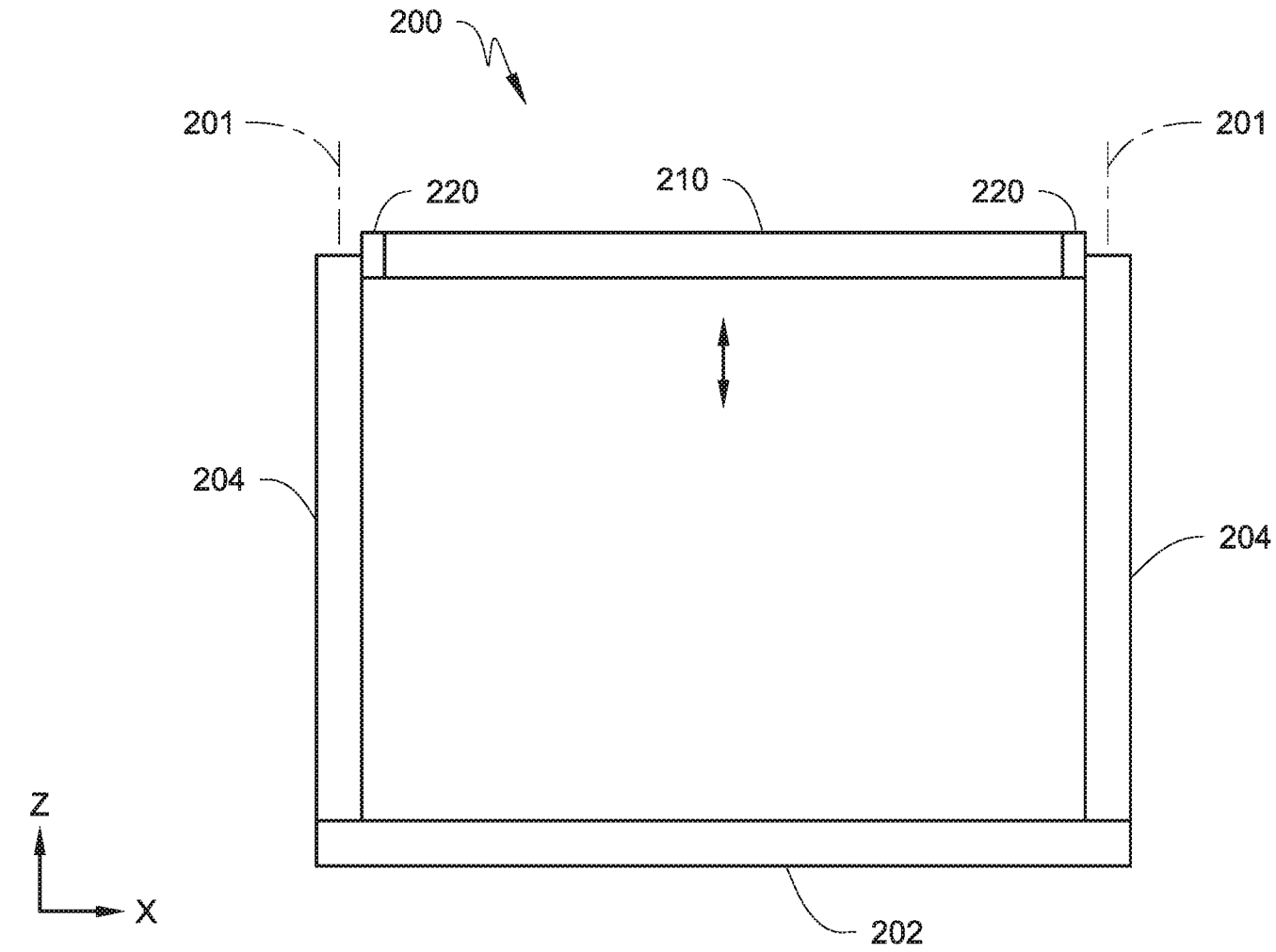
FIG. 5 is a schematic depiction of one illustrative embodiment of frame components of one illustrative embodiment of a sliding fenestration system as described herein.

One illustrative embodiment of frame components of one embodiment of a sliding fenestration system as described herein is depicted in FIG. 5. The components of the frame 200 include, in one or more embodiments, a sill 202 located along the bottom of the building opening, a pair of vertical side jambs 204 located along the sides of the building opening, and a head track 210 located along the top of the building opening. The vertical side jambs 204 each extend along a vertical axis 201, while the head track 210 extends along a horizontal axis between the vertical side jambs 204. Typically, the sill 202 and the vertical side jambs 204 are arranged orthogonally with each other in a building opening with the head track 210 oriented generally parallel to the sill 202. In one or more embodiments of, e.g., liftslide fenestration systems, the sill 202 may be in the form of, e.g., a draining sill assembly as described in U.S. Pat. No. 6,792,651 (Weiland et al.), although any sill capable of supporting the panels used in the sliding fenestration systems described herein may be used.

Figure 4:
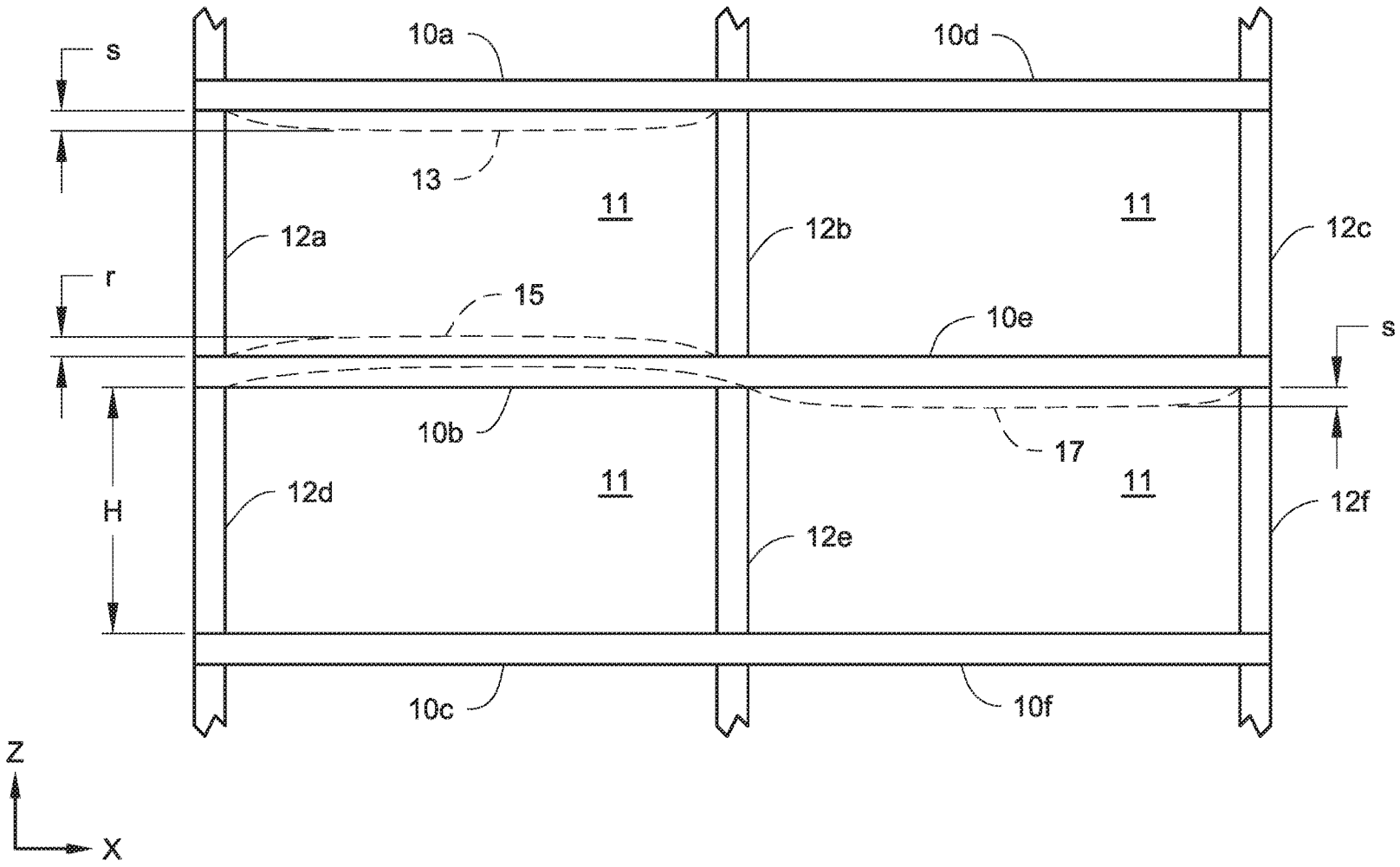
FIG. 4 is a schematic diagram of one embodiment of a multistory building having multiple building openings in which sliding fenestration systems may be installed.

In the depicted illustrative embodiment, the sliding fenestration system includes a left side jamb 204 attached to the left side of a building opening (see, e.g., building openings 11 in FIG. 4) in which the sliding fenestration system is installed, the left side jamb 204 having a top end and a bottom end. The bottom end of the left side jamb 204 is located proximate the sill 202 (e.g., the left end of the sill 202 may be located next to or underneath the left side jamb 204) and the top end of the left side jamb 204 is located proximate the left end of the head track 210. As a result, the left end of the head track 210 can be described as being located closer to the top end of the left side jamb 204 than the bottom end of the left side jamb 204 when the head track 210 is positioned along the top of the building opening in which the left side jamb 204 and the head track 210 are installed.

The depicted illustrative embodiment of the sliding fenestration system frame 200 includes a right side jamb 204 attached to the right side of a building opening (see, e.g., building openings 11 in FIG. 4) in which the sliding fenestration system frame 200 is installed, the right side jamb 204 having a top end and a bottom end. The bottom end of the right side jamb 204 is located proximate the sill 202 (e.g., the right end of the sill 202 may be located next to or underneath the right side jamb 204) and the top end of the right side jamb 204 is located proximate the right end of the head track 210. As a result, the right end of the head track 210 can be described as being located closer to the top end of the right side jamb 204 than the bottom end of the right side jamb 204 when the head track 210 is positioned along the top of the building opening in which the right side jamb 204 and the head track 210 are installed.

The head track 210 is, in one or more embodiments, attached to the top of the building opening (see, e.g., building openings 11 in FIG. 4) while the sill 202 is located along the bottom of the building opening. The right end of the head track 210 is configured to move along the right side jamb 204 along a vertical axis 201 extending between the top and bottom ends of the right side jamb 204 and the left end of the head track 210 is configured to move along the left side jamb 204 along a vertical axis 201 extending between the top and bottom ends of the left side jamb 204. As a result, the ends 220 of the head track 210 can move along the length of the left and right side jambs 204 as the opening height of a building opening in which the frame 200 is installed changes as discussed herein.

It should be understood that the one or both of the side jambs 204 depicted in connection with the illustrative embodiment of a sliding fenestration system of FIGS. 5-8 of frame 200 are optional, i.e., one of more embodiments of the sliding fenestration systems described herein may include only one or no side jambs. In systems that do not include two side jambs, the head track 210 may be described as extending from a first end to a second end between the first and second sides of a building opening when attached to the top of the opening. The first and second ends 220 of the head track 210 may further be described as being configured to move towards and away from the bottom of the building opening (and also the sill when present along the bottom of the opening). In other words, the ends 220 of the head track 210 are not fixedly attached to the sides of the building opening, nor are they located at a fixed height above the bottom of the building opening. As a result, the head track 210 (including its first and second ends 220), can move towards and away from the bottom of the building opening, while a sill at the bottom of the building opening can also move towards and away from the head track as the top and/or bottom of the building opening move in response to, e.g., changing loads within a building structure in which the building opening is located.

Figure 6:
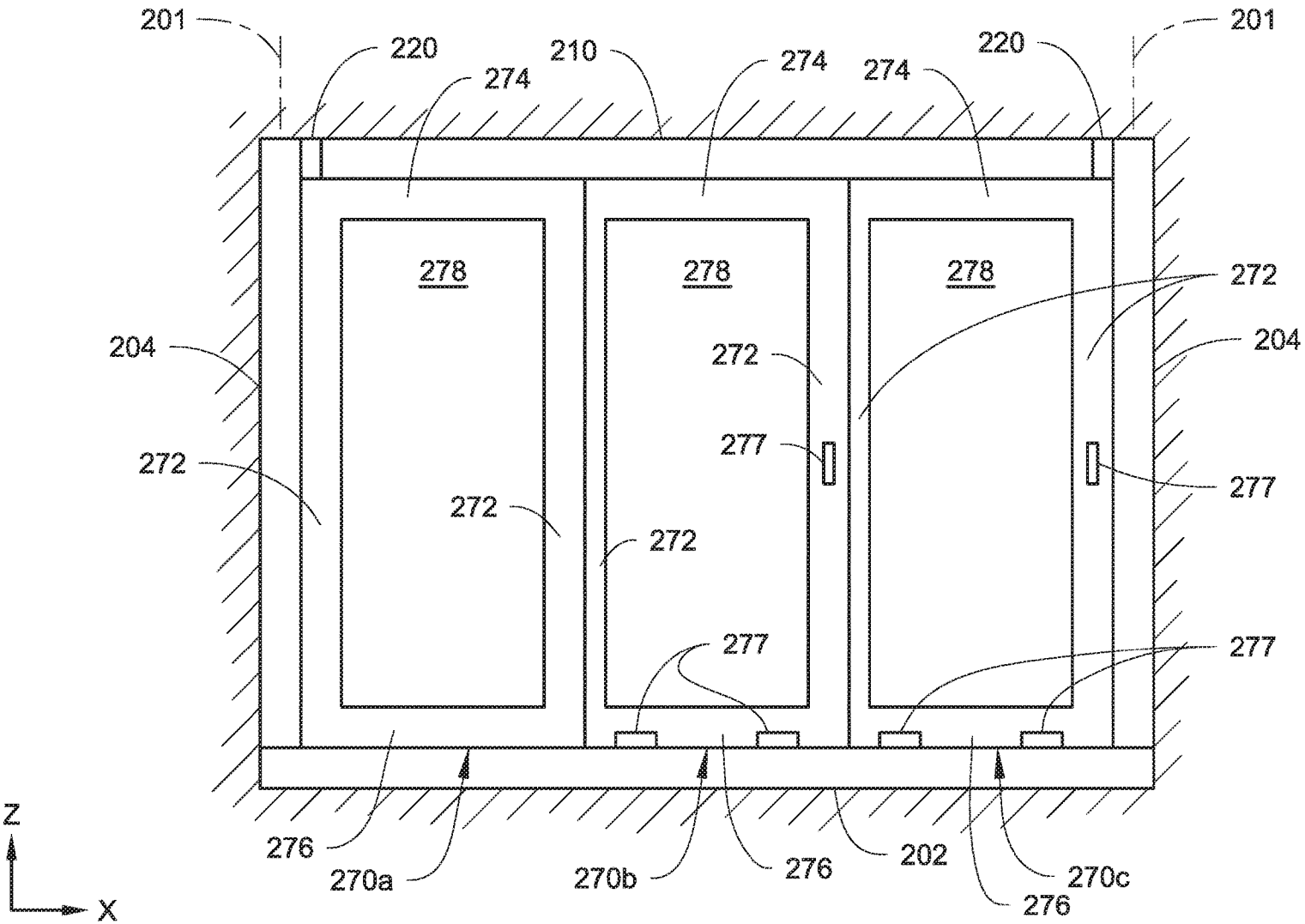
FIG. 6 is a schematic depiction of one illustrative embodiment of a sliding fenestration system as described herein in which the door panels are in their closed positions within a building opening.

The sliding fenestration system frame depicted in FIG. 5 is depicted in FIG. 6 along with three panels mounted within the frame. In particular, the sliding fenestration system depicted in FIG. 6 includes panels 270*a*, 270*b*, and 270*c* (collectively referred to as panel or panels 270 herein) positioned in the frame that includes sill 202, left and right side jambs 204, and head track 210.

One or more of the panels in the sliding fenestration systems as described herein may be described as a sliding panel. Sliding panels in sliding fenestration systems as described herein are movable between a closed position in which the building opening is closed to limit the passage of air and/or water through the building opening and an open position in which air and/or water may pass through the building opening. Typically, sliding panels in the open position may also allow for the passage of occupants through the building opening. In particular, sliding panels of sliding fenestration systems as described herein move away from one of the side jambs and toward the opposite side jamb in the building opening when moving between the closed and open positions.

Although the sliding fenestration system depicted in FIG. 6 includes three panels, one or more alternative embodiments of sliding fenestration systems as described herein may include as few as one panel, two panels, or four or more panels depending on the size of the building opening and/or the relative sizes of the panels located in the frame of the sliding fenestration system. Furthermore, although the depicted panels all have the same size, one or more alternative embodiments of sliding fenestration systems may include panels having different sizes.

Each of the panels 270 in the illustrative embodiment of sliding fenestration system depicted in FIG. 6 includes a frame in the form of a left and right stiles 272, a top rail 274, and a bottom rail 276. The top rail 274 extends between a top end of the left stile 272 to the top end of the right stile 272, while the bottom rail 276 extends between a bottom end of the left stile 272 to the bottom end of the right stile 272. In one or more embodiments, the panels 270 may also include a glazing unit 278 positioned in the frame of each of the panels 270, although in one or more alternative embodiments, the glazing unit 278 in one or more of the panels 270 may be replaced by a solid sheet (i.e., an opaque member as opposed to a transparent and/or translucent glazing panel). In still other alternative embodiments, one or more of the panels 270 may include a combination of glazing units and solid portions.

Movement of panels 270*b* and panel 270*c* may, in one or more embodiments of liftslide fenestration systems as described herein, be accomplished using a lift mechanism 277 that is operably connected to each of the sliding panels 270 (although not depicted in FIG. 6, panel 270*a* may also include a lift mechanism if that panel is a sliding panel within a sliding fenestration system as described herein). One or more embodiments of the lift mechanisms 277 used in connection with the sliding panels of liftslide versions of sliding fenestration systems as described herein may include an actuator on a stile (or elsewhere) and one or more components along the bottom rail 276 of the panel that are operably connected to the actuator. In one or more embodiments, the lift mechanisms 277 are configured to raise the sliding panels from a lowered configuration (in which they typically rest on the sill 202) to a raised configuration such that the panel 270 moves along the direction of a vertical axis such as, e.g., the vertical axes 201 along each of the side jambs 204. In the raised configuration the top rail 274 of each of the sliding panels 270 moves towards the head track 210. Once in the raised configuration, the sliding panels 270 can be moved between their open and closed positions as described herein.

In one or more embodiments of sliding fenestration systems as described herein, one or more of the sliding panels are movable between the opposing side jambs such that the sliding panels pass each other without interference. As a result, the sliding panels are typically arranged in a staggered relationship. One illustrative embodiment of a staggered relationship between panels 270 is depicted in the top view seen in FIG. 7, in which the head track 210 is removed to expose the top edges of the top rails of each of the panels 270.

Figure 7:
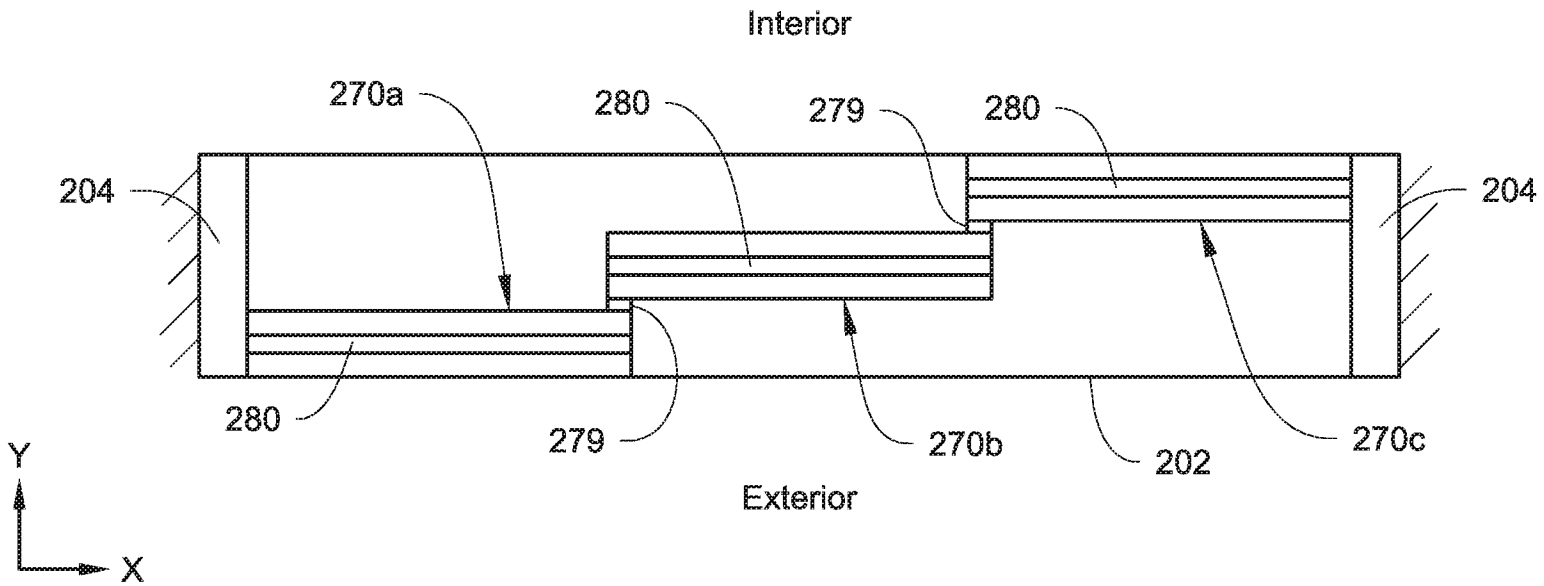
FIG. 7 depicts is a top view of the sliding fenestration system of FIG. 6 taken from above after removing the head track located above the door panels.

The panels 270 are depicted in FIG. 7 along with left and right side jambs 204 and sill 202 extending between the left and right side jambs 204. In particular, panel 270*a* is depicted in position against left side jamb 204 while sliding panel 270*c* is depicted in its closed position against right side jamb 204. Intermediate sliding panel 270*b* is depicted between left panel 270*a* and sliding panel 270*c*, with the intermediate sliding panel 270*b* in its closed position relative to the other panels in the depicted embodiment of a sliding fenestration system as described herein. In the depicted embodiment, left panel 270*a* may or may not be movable. Both intermediate panel 270*b* and panel 270*c* are, however, movable towards the left side jamb 204 along sill 202 in the depicted embodiment.

The exposed top edges of the top rails of each of the panels 270 each include a guide channel 280 that, in the depicted embodiment, extends along the entire width of the top rail of each of the panels 270. Other features that may be found in one or more embodiments of sliding fenestration systems as described herein are also seen in the top view of FIG. 7. For example, panel seals 279 are located between the intermediate panel 270*b* and the left panel 270*a* as well as between the intermediate panel 270*b* and the right panel 270*c*. The panel seals 279 are provided to limit or prevent the passage of air and/or water through the junctions formed between the intermediate panel 270*b* and each of the panels 270*a* and 270*c*. Structures capable of forming such panel seals 279 are well known and will not be further described herein.

Figure 8:
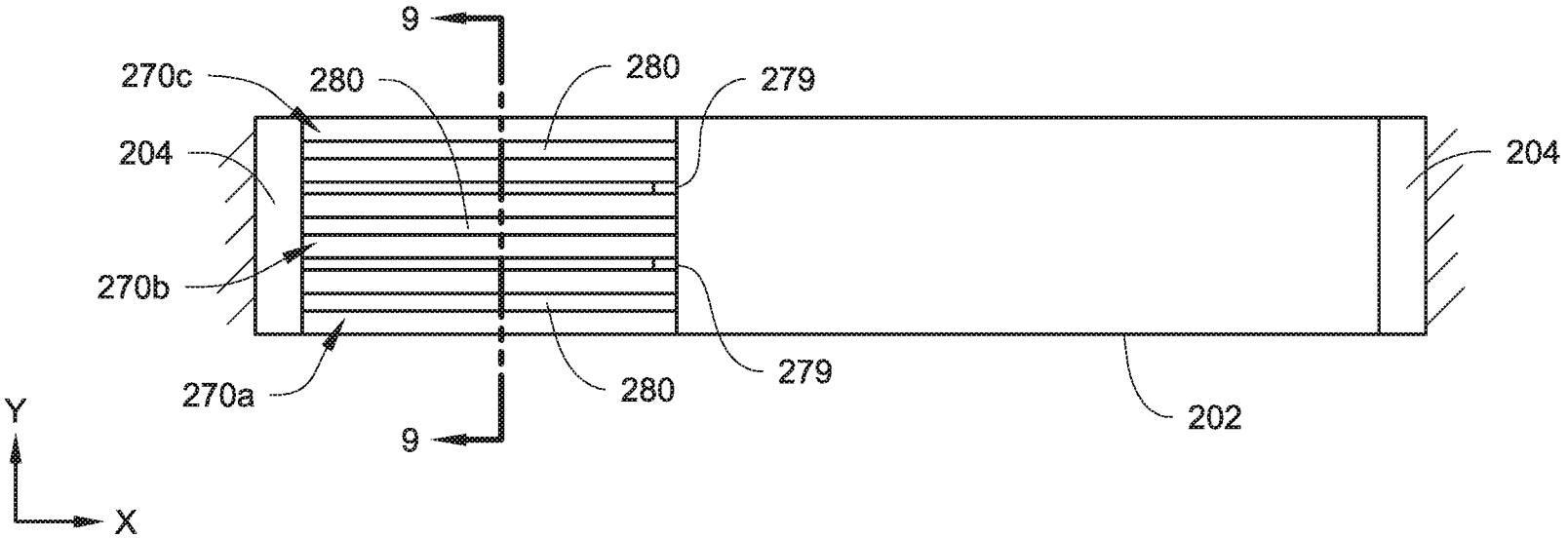
FIG. 8 depicts a top view of the sliding fenestration system of FIG. 7 after movement of the sliding door panels to their open positions within the building opening such that the sliding door panels are in a stacked relationship at one side of the building opening.

The panels 270 of the illustrative embodiment of a sliding fenestration system as described herein and depicted in FIGS. 6 and 7 are depicted in a stacked relationship in FIG. 8 (in which the head track of the sliding fenestration system is also removed as in FIG. 7). In particular, both panels 270*b* and 270*c* are depicted after they have been moved towards the left side jamb 204 such that they are aligned with panel 270*a*.

In one or more embodiments in which the panels 270 are not exposed when in the stacked relationship as seen in FIG. 8, the stacked panels 270 may be located in a pocket formed on one side of a building opening, although such an arrangement would still include both left and right side jambs, with the left side jamb 204 being located within the pocket as is known in connection with known sliding fenestration systems. In such a system, left panel 270 a may also be a sliding panel such that it can be moved into and out of the pocket when moving between its open (i.e., in pocket) and closed (i.e., out of pocket) position.

Figure 9:
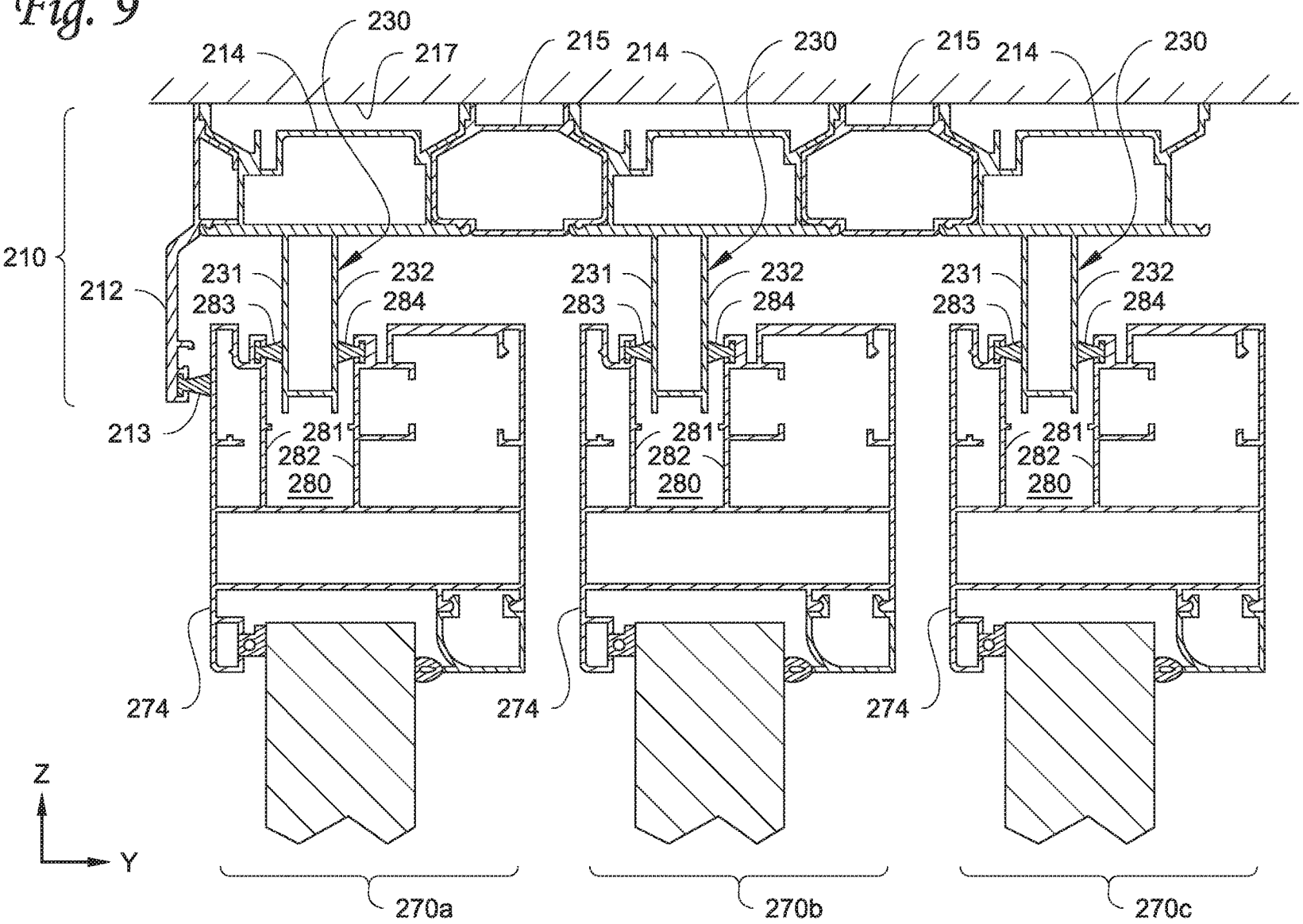
FIG. 9 is an enlarged cross-sectional view of one illustrative embodiment of the stacked door panels of FIG. 8 along with one illustrative embodiment of a head track used in a sliding fenestration system as described herein.

The upper portions of the stacked panels 270 and the head track 210 are depicted in an enlarged cross-sectional view as seen in FIG. 9 (where the cross-sectional view is taken along line 9-9 in FIG. 8). The depicted illustrative embodiment of head track 210 is attached to the top 217 of a building opening in which the sliding fenestration system using head track 210 is installed. The depicted embodiment of head track 210 includes a variety of components that, when assembled together, form the head track 210. The depicted head track 210 includes, e.g., guide members 214 separated by spacers 215, which together form the depicted illustrative embodiment of head track 210. The guide members 214 and spacers 215 may, in one or more embodiments, be constructed and connected to each other according to the principles described in, e.g., U.S. Pat. No. 6,381,911 (Weiland).

In addition to guide members 214 and spacers 215, one or more embodiments of a head track 210 as described herein may include an exterior fascia member 212 configured for attachment to the head track 210 on an exterior side of a sliding fenestration system as described herein. The exterior fascia member 212 may include a seal member 213 configured to form a seal with the top rail 274 of the outermost panel 270*a* of the group of panels 270 in one or more embodiments of a sliding fenestration system as described herein.

Although not depicted in the cross-sectional view of FIG. 9, one or more embodiments of a head track 210 as described herein may include one or more fascia components designed to provide a finished appearance on an interior side of the head track 210 for installations in which, e.g., the head track 210 is visible. Some examples of potentially suitable fascia members and their attachment may be described in, e.g., U.S. Pat. No. 6,381,911 (Weiland).

Each of the guide members 214 used in the illustrative embodiment of head track 210 depicted in FIG. 9 includes a guide rail 230 that, in one or more embodiments, preferably extends along the length of its respective guide member 214 (although in one or more embodiments, the guide rails 230 may only be needed over a length of the head track 210 that a panel 270 using the guide rail 230 to control movement travels between its open and closed positions). In one or more embodiments, the guide rails 230 can be described as projecting downward away from the head track 210 and the top 217 of the building opening to which the head track 210 is attached.

The depicted illustrative embodiments of guide rails 230 projecting downwardly from head track 210 may, in one or more embodiments, include an outer guide rail surface 231 and an inner guide rail surface 232, where the outer guide rail surface 231 and the inner guide rail surface 232 are located on opposite sides of the guide rail 230. In the depicted illustrative embodiment, each of panels 270*a*, 270*b*, and 270*c* are constructed to move along their respective guide rails 230 with at least a portion of the guide rail 230 located in guide channels 280 formed in the top rails 274 of each of the panels 270. The guide rails 230 guide movement of the panels 270 between their open and closed positions such that they remain in alignment with each other and with the building opening in which the sliding fenestration system including panels 270 is installed. Furthermore, the guide rails 230 provide support for the panels 270 such that lateral loads exerted on the panels 270 by, e.g., wind, etc. can be resisted when the panels 270 are located in a building opening. As discussed herein, direct attachment of the head track to the top of a building opening may provide improved lateral support to the top rails of panels located in sliding fenestration systems as described herein.

Each of the guide channels 280 formed in the top rails 274 of the panels 270 includes an outer channel surface 281 and an inner channel surface 282. The outer channel surface 281 may be described as facing the inner channel surface across the guide channel 280. Further, the outer channel surface 281 may be described as facing the outer guide rail surface 231 of a guide rail 230 positioned in the guide channel 280, while the inner channel surface 282 may be described as facing the inner guide rail surface 232 of the guide rail 230 positioned in the guide channel 280.

The depicted illustrative embodiment of a sliding fenestration system seen in FIG. 9 also includes a guide channel seal assembly provided to limit the passage of water and/or air through the guide channel 280. In one or more embodiments, the guide channel seal assemblies may include an outer seal member 283 located between the outer guide rail surface 231 and the outer guide channel surface 281, with the outer seal member 283 forming a seal between the surfaces 231 and 281. Although the outer seal member 283 is depicted as being attached to the top rail 274 within guide channel 280, the outer seal member 283 could, conversely, be attached to the guide rail 230. In one or more embodiments, the guide channel seal assemblies also include an inner seal member 284 located between the inner guide rail surface 232 and the inner guide channel surface 282, with the inner seal member 284 forming a seal between the surfaces 232 and 282. Again, although the inner seal member 284 is depicted as being attached to the top rail 274 within guide channel 280, the inner seal member 284 could, conversely, be attached to the guide rail 230.

Although the depicted illustrative embodiment includes both an inner seal and an outer seal, in one or more alternative embodiments, the guide channel seal assemblies provided in sliding fenestration systems as described herein may include only one seal, e.g., an inner seal or an outer seal. Further, the seal members used to create the inner and/or outer seals may be in the form of any materials used to provide weatherstripping in fenestration units, e.g., pile element (e.g. mohair, etc.), resilient elastomeric bodies, etc. The seal members may, in one or more embodiments, preferably be adapted to slide with the panel in the x-axis direction as the movable panels slide between their open and closed positions. In liftslide fenestration systems, the seal members are also adapted to slide in the z-axis direction as the panels are moved between their raised and lowered positions. In one or more embodiments, one or both of the inner and outer seals formed by the guide channel seal assembly extend along substantially all of the length of the guide channel such that, e.g., the inner and/or outer seals occupy 90% or more of the length of the guide channel.

The guide rails 230 of head track 210 preferably extend the downwardly by a distance sufficient to allow vertical movement along the z-axis of the top rail 274 and the head track 210 relative to each other. In other words, the head track 210 and top rails 274 may move towards and/or away from each other as the building opening height changes due to movement of the top 217 of the building opening and/or the sill located along the bottom of the building opening (on which the panels 270 rest), with either or both of the top and bottom of the building opening moving as discussed herein. Increasing the height of the guide rails 230 and the channels 280 in the top rails of the panels 270 along the z-axis can accommodate these changes in building opening height while maintaining lateral support of the panels (along the y-axis) and providing guidance of the panels when sliding between their open and closed positions (along the x-axis).

In one or more embodiments of liftslide fenestration systems, the guide rails 230 of the head track 210 extend downwardly farther than needed to accommodate changes in building opening height because panels 270 are raised and lower during operation of the liftslide fenestration systems. Increasing the height of the guide rails 230 along the z-axis can accommodate these additional travel requirements. In addition to increasing the height of the guide rails 230 along the z-axis to accommodate the additional travel requirements, the guide channels 280 in the top rails 274 of panels used in sliding fenestration systems as described herein may also have an increased depth to also accommodate the increased travel requirements as described herein.

Further, in one or more embodiments, it may also be desirable to maintain one or both of the inner and outer seals formed between the guide channels 280 and the guide rails 230 at all times during movement of the head track 210 and/or the top rails 274 along the z-axis. In one or more embodiments, the outer and inner guide rail surfaces 231 and 232 may preferably be oriented vertically such that movement of the seal members 283 and 284 vertically due to raising/lowering of the panels 270, as well as changes in the position of the head track 210 relative to the sill supporting the panels 270, does not substantially affect the integrity of the seals formed by the seal members traveling along the outer and inner guide rail surfaces 231 and 232. In one or more embodiments, the outer and inner guide rail surfaces 231 and 232 may be described as located in planes that are oriented parallel to each other such that movement along both the z-axis as well as the x-axis (during movement of a panel 270 between its open and closed positions) does not substantially affect the integrity of those seals. In other words, the seals formed between the guide channels 280 and guide rails 230 in one or more embodiments of the sliding fenestration systems as described herein maintain sealing contact regardless of the relative positions of the head track 210 and the top rail 274 of a panel located in the system. For liftslide systems, the seals formed between the guide channels 280 and guide rails 230 maintain sealing contact when the sliding panels are in both their raised and lowered configurations.

In an embodiment in which the seal members are attached to the guide rails 230, the outer and inner guide channel surfaces 281 and 282 may preferably be oriented vertically such that movement of the guide channel surfaces vertically due to changes in the position of the head track 210 relative to the sill supporting the panels 270 (which may be also be caused by raising/lowering of the panels in liftslide systems) does not substantially affect the integrity of the seals formed by the seal members moving relative to the outer and inner guide channel surfaces 281 and 282.

Figure 10:
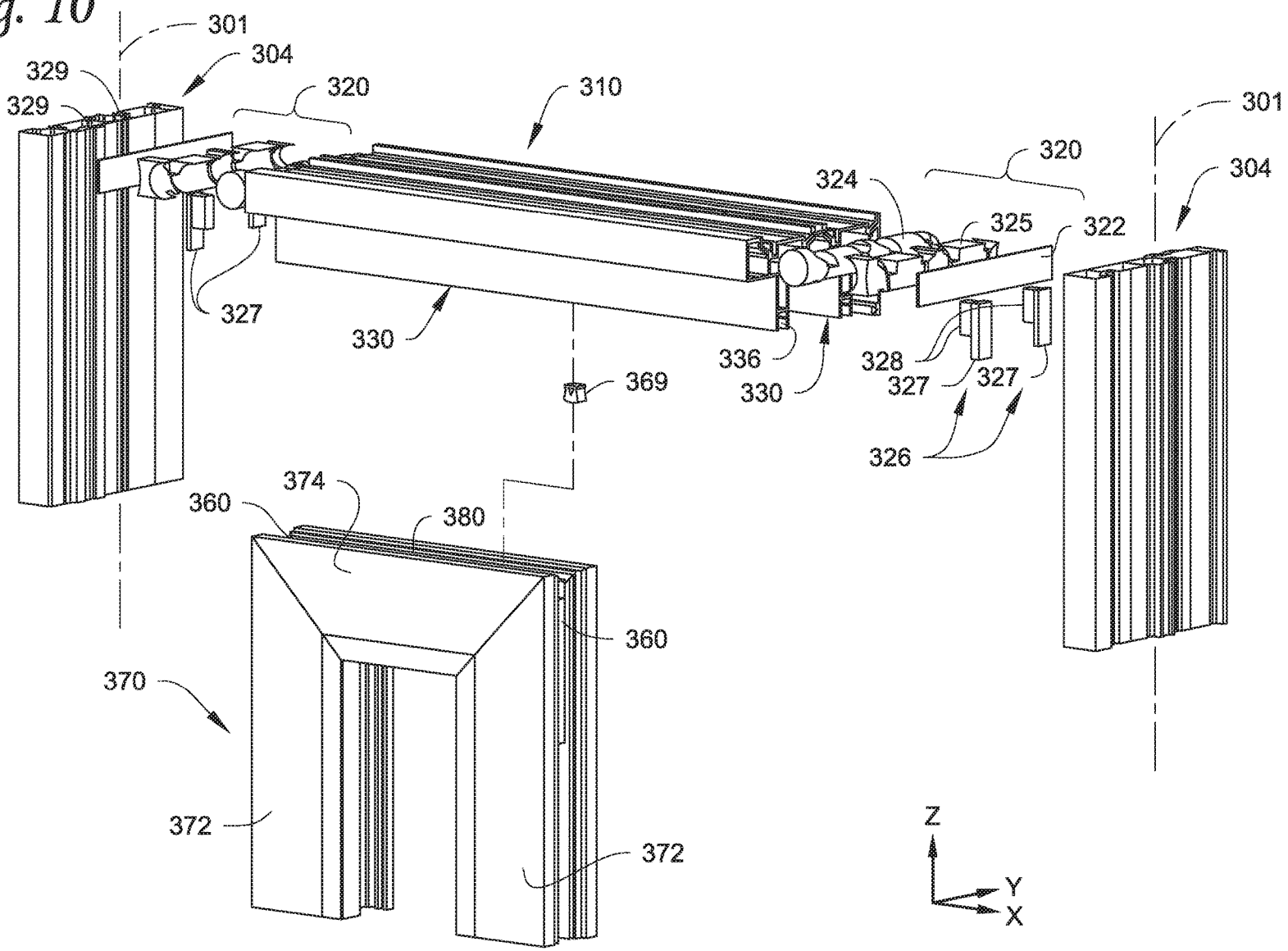
FIG. 10 is an exploded assembly diagram of a portion of one illustrative embodiment of a sliding fenestration system as described herein.
Figure 11:
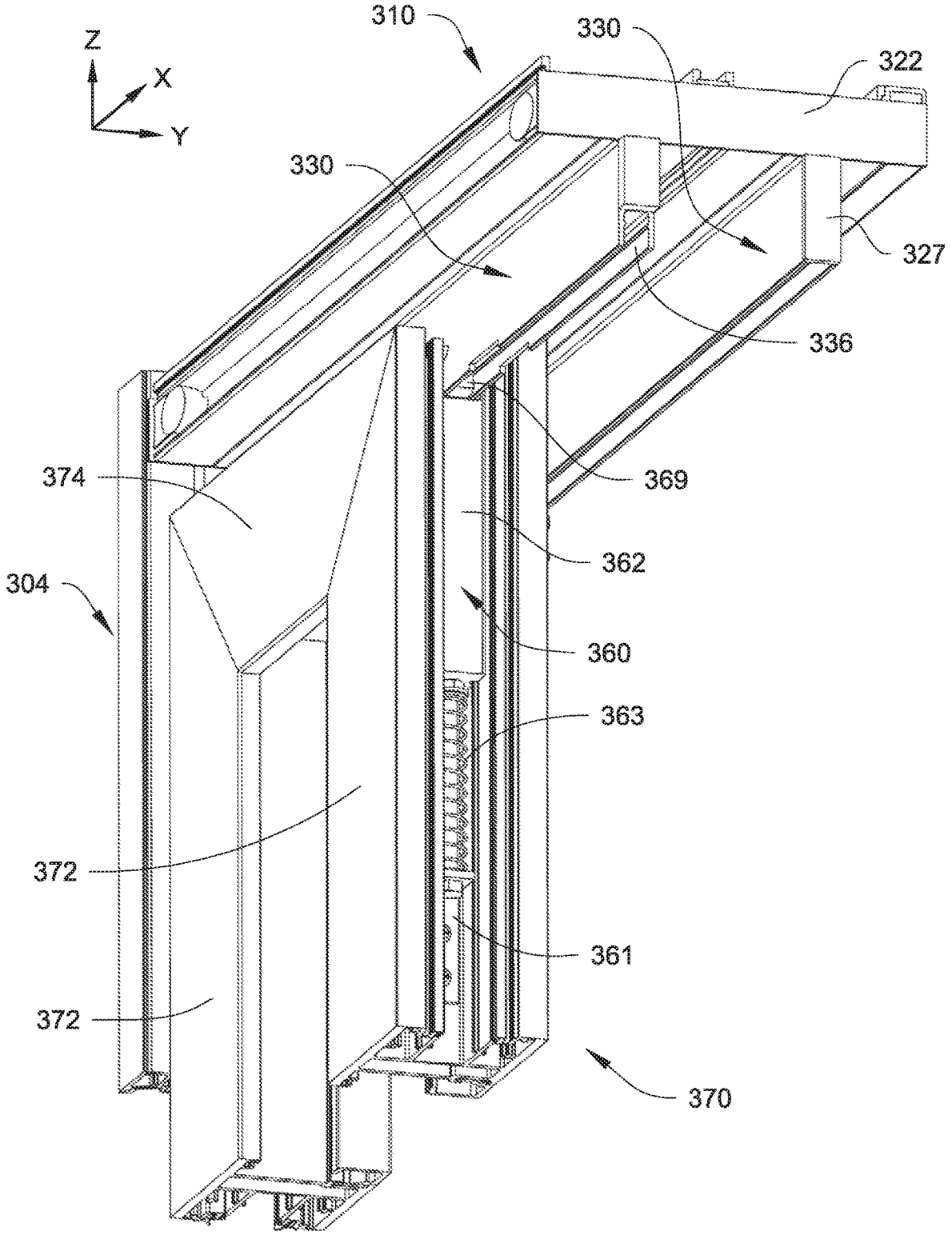
FIG. 11 is a perspective view of the illustrative embodiment of a portion of the sliding fenestration system depicted in FIG. 10 with only one of the door panels assembled with the head track.

Some components of another illustrative embodiment of a sliding fenestration system as described herein are depicted in FIGS. 10 and 11. The depicted illustrative embodiment includes a head track 310 that includes only two guide rails 330 projecting downwardly. The head track 310 is located between a pair of vertical side jambs 304, each of which extend along a vertical axis 301 in a manner similar to other vertical side jambs as described herein. Also depicted in FIGS. 10 and 11 are a portion of sliding panel 370 that includes vertical stiles 372 and a top rail 374 extending between the vertical stiles 372. The top rail 374 includes a guide channel 380 that receives at least a portion of a guide rail 330 on the head track 310 when the sliding fenestration system is assembled and installed in an opening as described herein.

Sliding fenestration systems as described herein include a head track that is configured to move with the top of a building opening towards and away from the bottom of the building opening. When described in relation to side jambs located on opposite ends of the head track, the sliding fenestration systems as described herein may be described as having a head track configured to move vertically along the side jamb in a direction extending between the top and bottom ends of each of the side jambs.

In connection with the illustrative embodiment of the sliding fenestration system as depicted in FIGS. 10 and 11, the head track 310 may be described as including a left end located proximate the left side jamb 304 and a right end located proximate the right side jamb 304. At both ends, the head track 310 may be described as being located closer to the top ends of the side jambs 304 than the bottom ends of the side jambs 304. Further, the left and right ends of the head track 310 are configured to move along vertical axes 301 that extend between the top and bottom ends of the respective side jambs two, as described herein, to accommodate changes in the height of a building opening in which the sliding fenestration system including head track 310 and side jambs 304 are installed.

In addition to being configured for movement, the head tracks and side jambs of sliding fenestration systems as described herein may, in one or more embodiments, include head track slide assemblies 320 at the junctions between the left and right ends of the head track and the left and right side jambs. In one or more embodiments, the head track slide assemblies 320 may be described as forming head track end seals between the ends of the head track 310 and each of the side jambs 304. The head track and seals formed by the head track slide assemblies 320 may, in one or more embodiments, allow for movement of the head track 310 relative to the side jambs 304 while maintaining a seal that substantially limits or prevents the passage of air and/or water through the junctions between the ends of the head track 310 and the side jambs 304.

Sealing of the junctions between the ends of the head track 310 and the side jambs 304 may be accomplished by a variety of components. In the depicted illustrative embodiment, the seals may be formed using a backer rod 324 inserted into the end of the head track 310, followed by application of silicone or another flowable sealant 325, with a seal member 322 (e.g., foam tape, etc.) positioned over the sealant 325. Many other different techniques and/or components may be used to form suitable end seals between the ends of the head track 310 and side jambs 304.

In addition to providing seals at the ends of the head track 310, one or more embodiments of the head track slide assemblies 320 as described herein may optionally include components to maintain lateral alignment (i.e. alignment along the y-axis that extends between the interior and exterior sides of a sliding fenestration system as described herein) between the ends of the head track and the side jambs 304.

In one or more embodiments, lateral alignment between the ends of the head track 310 and the side jambs 304 may be accomplished using slide blocks 326 as depicted in FIGS. 10 and 11. Each of the slide blocks 326 includes a slide 327 and a plug 328 (see, e.g., FIG. 10). The plugs 328 of the slide blocks 326 may, in one or more embodiments, be configured to fit within a cavity formed in the ends of each of the guide rails 330 such that the slides 327 are positioned at the ends of the guide rails 330 as depicted in, e.g., FIG. 11. In one or more embodiments, the slides 327 of the slide blocks 326 may be configured to move within complementary alignment channels formed in the side jambs 304 as the ends of the head track 310 move vertically along the z-axis relative to the side jambs 304. One set of illustrative alignment channels 329 are depicted in FIG. 10 on the left side jamb 304. The slides 327 and complementary alignment channels 329 may assist in maintaining proper alignment of the ends of the head track 310 with the side jambs 304 in response to forces directed on those components along the y-axis. It should be understood that slide blocks 326 represent only one example of structures that may be used to provide lateral alignment between the ends of head tracks and their respective side jambs in sliding fenestration systems as described herein. Other examples of potentially suitable lateral alignment structures may include, e.g., pins, posts, interlocking channels, etc.

Although the passage of air and/or water through the junctions between the guide channels on panels and the guide rails on head tracks of sliding fenestration systems as described herein may be limited by one or more seals formed within the guide channels, passage of air/and or water may potentially occur at the outer edges of the stiles on panels of sliding fenestration systems as described herein. To address that potential leakage, one or more embodiments of panels of sliding fenestration systems as described herein may include sliding seal assemblies located along the stiles at the ends of the guide channels provided in the top rails of the panels. The sliding seal assemblies may be located in cavities formed along one or both of the stiles of a panel used in a sliding fenestration system as described herein.

Illustrative embodiment of sliding seal assemblies 360 are depicted in cavities in stiles 372 of panel 370 as depicted in FIGS. 10 and 11. One sliding seal assembly 360 is depicted after removal from its cavity in a stile in FIG. 12. The depicted illustrative embodiment of sliding seal assembly 360 includes a sliding guide 362 and a biasing member 363 operably connected to the sliding guide 362. The sliding guide 362 includes a U-shaped bearing end that includes a base 366 and a pair of legs 368 that extend upwardly away from the base 366.

In one or more embodiments, the U-shaped bearing end receives a portion of the guide rail 330 between the legs 368 when the base 366 of the U-shaped bearing end is in contact with the guide rail 330. In one or more embodiments, the U-shaped bearing end of the sliding guide 362 be described as being aligned with the guide channel 380 in the top rail 374 of the panel 370 when the panel 370 is assembled with the head track in a building opening such that at least a portion of the guide rail of the head track is located in the guide channel 380 of the panel 370.

When in position with a portion of a guide rail located between the legs 368 of the U-shaped bearing end, the legs 368 may be described as including an inner leg positioned between the inner guide rail surface and the inner channel surface in the channel 380 in the top rail 374 of the panel 370. The legs 368 may also include an outer leg positioned between the outer guide rail surface and the outer channel surface in the channel 380 in the top rail 374 of the panel 370.

In one or more embodiments of sliding fenestration systems as described herein, the legs 368 of the sliding guide 362 may function as sliding guides to facilitate movement of the panels 370 along guide rails 330. In such embodiments, it may be desirable to manufacture the legs 368 of sliding guides 362 of materials that exhibit relatively low friction while maintaining durability during repeated movement of the panels between their open and closed positions. Examples of potentially suitable materials for the sliding guides may include, but are not limited to, polymers such as, e.g., polyoxymethylene (commonly available under the tradename Delrin), nylon, etc. The polymers used may be filled with one or more materials (e.g., glass fibers, polytetrafluorethylene (PTFE), etc.) to improve strength, reduce friction, etc.

Figure 12:
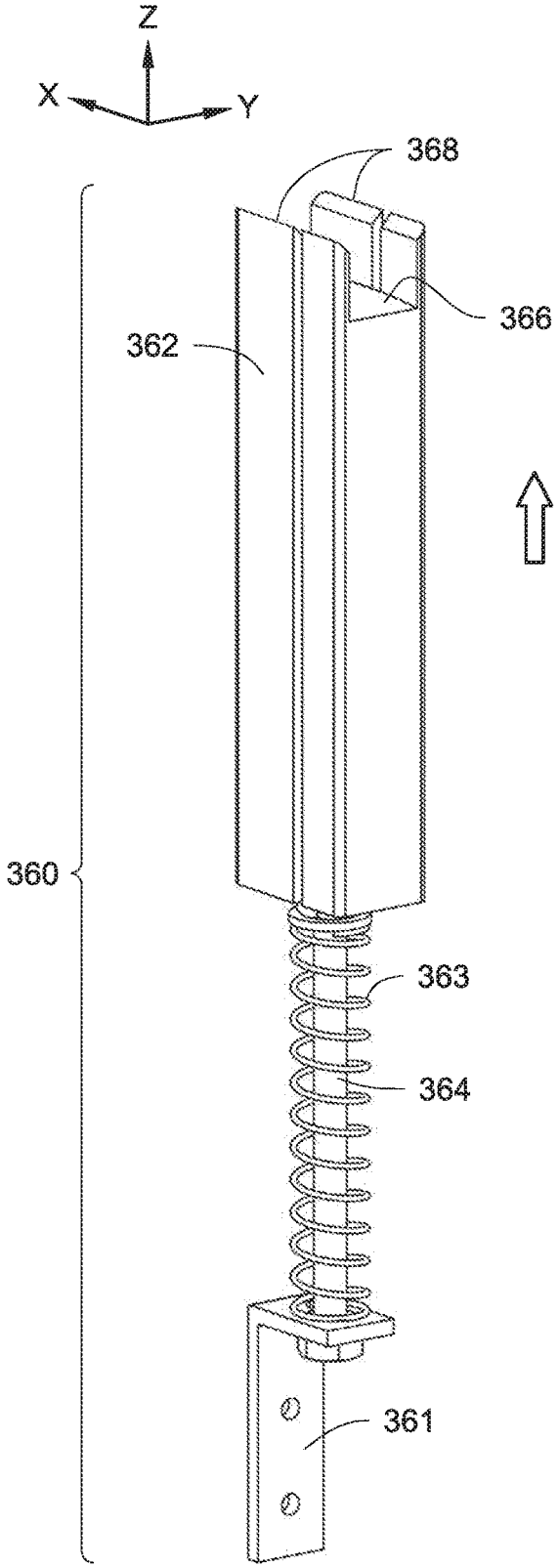
FIG. 12 depicts one illustrative embodiment of a sliding seal assembly that may be used in one or more illustrative embodiments of sliding panels of one or more illustrative embodiments of a sliding fenestration system as described herein.

When installed on a sliding panel of a sliding fenestration system as described herein, the sliding guide 362 is movable along the first stile of the panel 370 while the biasing member 363 biases the sliding guide 362 upward in the direction of the arrow included in FIG. 12. As a result, the sliding guide 362 maintains contact with the guide rail 330 of the head track 310 as the distance between the head track 310 and the panel 370 changes due to changes in building opening height (and due to moving a panel between its raised and lowered configurations in liftslide systems).

The biasing member 363 in the depicted illustrative embodiment is in the form of a coil spring through which a bolt 364 extends to both maintain alignment of the coil spring 363 (and, optionally, to provide a guide along which sliding guide 362 moves). The bolt 364 is attached to a mounting bracket 361 which is fixedly attached to the stile 372 of the panel 370.

Although the depicted biasing member is in the form of a coil spring, any suitable structure capable of forcing the sliding guide 362 towards the guide rail 330 may be used in place of a coil spring. For example, one or more biasing members in the form of one or more of a resiliently elastomeric body, a compressible bladder, magnets, etc. may be used in addition to or in place of a coil spring to provide a biasing force on a sliding guide of a sliding seal assembly as described herein.

Figure 13:
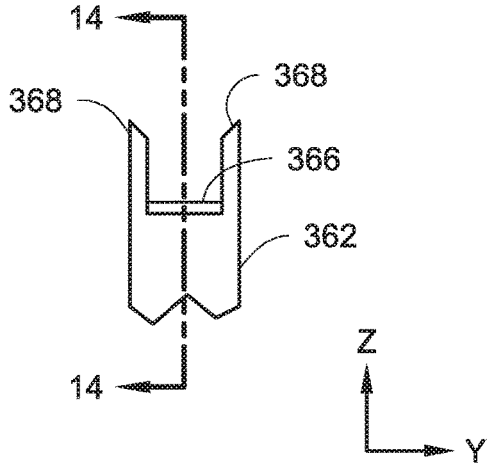
FIG. 13 is a side view of the upper end of the sliding guide of the sliding seal assembly depicted in FIG. 12.
Figure 14:
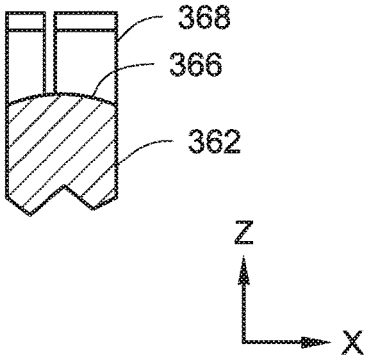
FIG. 14 is a cross-sectional view of the upper end of the sliding guide of the sliding seal assembly depicted in FIG. 13.

A view of the U-shaped bearing end of the sliding guide 362 along the direction of the x-axis is depicted in FIG. 13. As seen there, the legs 368 are located on each side of the base 366 of the U-shaped bearing end of the sliding guide 362. A cross-sectional view of the U-shaped bearing end of the sliding guide 362 taken along line 14-14 in FIG. 13 is depicted in FIG. 14. As seen in FIG. 14, the base 366 may, in one or more embodiments, be in the form of an arcuate surface configured to contact the guide rail 330 along a contact line oriented transverse to the length of the guide rail. In other words, a contact line oriented generally along the y-axis (see, e.g., FIG. 13). Limiting contact of the base 366 of the U-shaped bearing end of the sliding guide 362 with a guide rail 330 against which the sliding guide 362 is biased may limit wear on the base 366 as well as reduce friction during sliding movement of a panel in which the sliding guide 362 is located.

Although the sliding guide 362 of the sliding seal assembly 360 may, alone, assist in limiting the passage of air and/or water around the guide rail 330 at the ends of the panel 370, it may be beneficial to provide a guide rail seal on the guide rail 330 that is aligned with the sliding guide 362 when the panel 370 is in its closed position within a building opening. One illustrative embodiment of a guide rail seal 369 is depicted in FIG. 10. The depicted embodiment of guide rail seal 369 may be positioned in a seal channel 336 located on guide rail 330 (see, e.g., FIG. 11) such that the base 366 of the U-shaped bearing end of the sliding guide 362 of the sliding seal assembly 360 contacts the guide rail seal 369 to form a seal when those components are aligned with each other when the panel 370 is in its closed position. The guide rail seal 369 may, in one or more embodiments, exhibit some conformability such that it conforms against the base 366 of the U-shaped bearing end of the sliding guide 362 to limit the passage of air and/or water. For example, in one or more embodiments, the guide rail seal 369 may be in the form of any materials used to provide weatherstripping in fenestration units, e.g., a pile element (e.g. mohair, etc.), resilient elastomeric body, etc.

It should be understood that although illustrative systems and methods are described herein as "comprising" one or more components, features or steps, the methods may "comprise," "consists of," or "consist essentially of" any of the above-described components and/or features and/or steps. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a system or method that "comprises" a list of elements (e.g., components or features or steps) is not necessarily limited to only those elements (or components or features or steps), but may include other elements (or components or features or steps) not expressly listed or inherent to the method.

As used herein, the singular forms "a," "an," and "the" include plural referents unless the context clearly dictates otherwise. Thus, for example, reference to "a" or "the" component may include one or more of the components and equivalents thereof known to those skilled in the art. Further, the term "and/or" means one or all of the listed elements or a combination of any two or more of the listed elements.

Further, the term "comprises" and variations thereof do not have a limiting meaning where these terms appear in the accompanying description. Moreover, "a," "an," "the," "at least one," and "one or more" are used interchangeably herein.

As used herein, the transitional phrases "consists essentially of" and "consisting of" are used to define a system or method that includes materials, steps, features, components, or elements, in addition to those literally disclosed, provided that these additional materials, steps, features, components, or elements do not materially affect the basic and novel characteristic(s) of the claimed invention.

The complete disclosure of the patents, patent documents, and publications identified herein are incorporated by reference in their entirety as if each were individually incorporated. To the extent there is a conflict or discrepancy between this document and the disclosure in any such incorporated document, this document will control.

From the above disclosure of the general principles of the present invention and the preceding detailed description, those skilled in this art will readily comprehend the various modifications, re-arrangements and substitutions to which the present invention is susceptible, as well as the various advantages and benefits the present invention may provide. Therefore, the scope of the invention should be limited only by the following claims and equivalents thereof. In addition, it is understood to be within the scope of the present invention that the disclosed and claimed articles and methods may be useful in applications other than surgical procedures. Therefore, the scope of the invention may be broadened to include the use of the claimed and disclosed methods for such other applications.

The invention claimed is:

1. A sliding fenestration system configured for installation in a building opening that includes a bottom, first and second sides, and a top, wherein the bottom extends between the first and second sides at the bottom of the building opening, and wherein the top extends between the first and second sides at the top of the building opening, the fenestration system comprising:

a head track extending from a first end to a second end, the head track attached to the top of building opening between the first and second sides of the building opening, wherein the first and second ends of the head track are configured to move towards and away from the bottom of the building opening with the top of the building opening, wherein the head track comprises a guide rail projecting downward away from the top of the building opening, and wherein the guide rail comprises an inner guide rail surface and an outer guide rail surface located on an opposite side of the guide rail from the inner guide rail surface, and further wherein the guide rail moves with the head track towards and away from the bottom of the building opening with the top of the building opening;

a sliding panel configured for sliding movement between the first end and the second end of the head track along a direction defined by the guide rail of the head track, wherein the sliding panel comprises a frame that comprises a first stile, a second stile, a bottom rail, and a top rail, wherein the top rail extends between a top end of the first stile and a top end of the second stile, and wherein the bottom rail extends between a bottom end of the first stile and a bottom end of the second stile; and a guide channel in the top rail of the sliding panel, wherein the guide channel comprises an inner channel surface and an outer channel surface, wherein the inner channel surface faces the outer channel surface across the guide channel, wherein at least a portion of the guide rail of the head track is located in the guide channel when the sliding panel is assembled with the head track in the building opening, and wherein the inner channel surface faces the inner guide rail surface and the outer channel surface faces the outer guide rail surface, and further wherein the guide rail on the head track moves within the guide channel when the head track moves towards and away from the bottom of the opening.

2. A fenestration system according to claim 1, wherein the fenestration system further comprises a guide channel seal assembly located in the guide channel between the guide rail and the guide channel, wherein the guide channel seal assembly forms a seal in the guide channel.

3. A fenestration system according to claim 2, wherein the guide channel seal assembly comprises an inner seal between the inner guide rail surface and the inner channel surface.

4. A fenestration system according to claim 2, wherein the guide channel seal assembly comprises an outer seal between the outer guide rail surface and the outer channel surface.

5. A fenestration system according to claim 1, the system further comprising:

a lift mechanism operably connected to the sliding panel, wherein the lift mechanism is configured to raise the sliding panel from a lowered configuration to a raised configuration, wherein the top rail of the sliding panel moves towards the head track when moving from the lowered configuration to the raised configuration; and a guide channel seal assembly located in the guide channel between the guide rail and the guide channel, wherein the guide channel seal assembly forms a seal in the guide channel when the sliding panel is in both the raised and lowered configurations.

6. A fenestration system according to claim 1, wherein the sliding panel further comprises a first sliding seal assembly attached to the first stile proximate the top rail of the sliding panel, wherein the first sliding seal assembly comprises a sliding guide and a biasing member operably connected to the sliding guiding, wherein the biasing member is configured to bias the sliding guide against the guide rail of the head track, and wherein the sliding guide is movable along the first stile such that the sliding guide maintains contact with the guide rail of the head track as a distance between the top rail of the sliding panel and the head track changes.

7. A fenestration system according to claim 6, wherein the sliding guide comprises a U-shaped bearing end comprising a base and a pair of legs, wherein U-shaped bearing end receives a portion of the guide rail between the pair of legs when the base is in contact with the guide rail.

8. A fenestration system according to claim 6, wherein the sliding panel is movable along the guide rail of the head track into and out of a closed position, wherein the sliding guide of the first sliding seal assembly is aligned with a guide rail seal attached to the guide rail when the sliding panel is in the closed position, wherein the sliding guide and the guide rail seal form a seal when aligned with each other.

9. A fenestration system according to claim 1, wherein the sliding panel further comprises a second sliding seal assembly attached to the second stile proximate the top rail of the sliding panel, wherein the second sliding seal assembly comprises a second sliding guide and a second biasing member operably connected to the second sliding guiding, wherein the second biasing member is configured to bias the second sliding guide against the guide rail of the head track, and wherein the second sliding guide is movable along the second stile such that the second sliding guide maintains contact with the guide rail of the head track as a distance between the top rail of the sliding panel and the head track changes.

10. A fenestration system according to claim 9, wherein the second sliding guide of the second sliding seal assembly comprises a U-shaped bearing end comprising a base and a pair of legs, wherein U-shaped bearing end of the second sliding guide receives a portion of the guide rail between the legs when the base is in contact with the guide rail.

11. A fenestration system according to claim 9, wherein the sliding panel is movable along the guide rail of the head track into and out of a closed position, wherein the second sliding guide of the second sliding seal assembly is aligned with a second guide rail seal attached to the guide rail when the sliding panel is in the closed position, wherein the second sliding guide and the second guide rail seal form a second seal when aligned with each other.

12. A fenestration system according to claim 1, wherein the fenestration system further comprises a first side jamb comprising a top end and a bottom end, wherein the first end of the head track is located closer to the top end of the first side jamb than the bottom end of the first side jamb when the head track is positioned along the top of the building opening and the first side jamb is positioned along the first side of the building opening, and wherein the first end of the head track is configured to move along the first side jamb along a first axis extending between the top and bottom ends of the first side jamb.

13. A fenestration system according to claim 12, wherein the fenestration system comprises a first head track slide assembly proximate a junction of the first end of the head track and the first side jamb, wherein first head track slide assembly forms a first head track end seal between the first end of the head track and the first side jamb as the first end of the head track moves along the first axis.

14. A fenestration system according to claim 12, wherein the fenestration system comprises:

a second side jamb comprising a top end and a bottom end, wherein the second end of the head track is located closer to the top end of the second side jamb than the bottom end of the second side jamb when the head track is positioned along the top of the building opening and the second side jamb is positioned along the second side of the building opening, and wherein the second end of the head track is configured to move along a second axis extending along the second side jamb between the top and bottom ends of the second side jamb when the head track is attached to the header of the building opening and the second side jamb is attached to the second side of the building opening; and a second head track slide assembly proximate a junction of the second end of the head track and the second side jamb, wherein second head track slide assembly forms a second head track end seal between the second end of the head track and the second side jamb as the second end of the head track moves along the second axis.

15. A fenestration system according to claim 1, wherein the fenestration system comprises:

a second guide rail projecting downward away from the header of the building opening, wherein the second guide rail comprises an inner guide rail surface and an outer guide rail surface located on an opposite side of the guide rail from the inner guide rail surface, wherein the second guide rail is aligned with the guide rail;

a second sliding panel configured for sliding movement between the first end and the second end of the head track along a direction defined by the second guide rail of the head track, wherein the second sliding panel comprises a frame that comprises a first stile, a second stile, a bottom rail, and a top rail, wherein the top rail of the second sliding panel extends between a top end of the first stile and a top end of the second stile, and wherein the bottom rail of the second sliding panel extends between a bottom end of the first stile and a bottom end of the second stile; and a guide channel in the top rail of the second sliding panel, wherein the guide channel of the second sliding panel comprises an inner channel surface and an outer channel surface, wherein the inner channel surface faces the outer channel surface across the guide channel of the second sliding panel, wherein at least a portion of the second guide rail of the head track is located in the guide channel of the second sliding panel when the second sliding panel is assembled with the head track in the building opening, and wherein the inner channel surface of the second sliding panel faces the inner guide rail surface of the second guide rail and the outer channel surface of the second sliding panel faces the outer guide rail surface of the second guide rail.

16. A fenestration system according to claim 15, wherein the fenestration system further comprises a second guide channel seal assembly located in the guide channel of the second sliding panel between the guide channel of the second sliding panel and the second guide rail, wherein the second guide channel seal assembly forms a seal in the guide channel of the second sliding panel.

17. A fenestration system according to claim 15, the system further comprising:

a second lift mechanism operably connected to the second sliding panel, wherein the second lift mechanism is configured to raise the second sliding panel from a lowered configuration to a raised configuration, wherein the top rail of the second sliding panel moves towards the head track when moving from the lowered configuration to the raised configuration; and a second guide channel seal assembly located in the guide channel of the second sliding panel between the second guide rail and the guide channel, wherein the second guide channel seal assembly forms a seal in the guide channel of the second sliding panel when the second sliding panel is in both the raised and lowered configurations.

18. A fenestration system according to claim 15, wherein the second sliding panel further comprises a second sliding seal assembly attached to the second stile proximate the top rail of the second sliding panel, wherein the second sliding seal assembly comprises a second sliding guide and a second biasing member operably connected to the second sliding guiding, wherein the second biasing member is configured to bias the second sliding guide against the second guide rail of the head track, and wherein the second sliding guide is movable along the second stile of the second sliding panel such that the second sliding guide maintains contact with the second guide rail of the head track as a distance between the top rail of the second sliding panel and the head track changes.

19. A sliding fenestration system configured for installation in a building opening that includes a bottom, first and second sides, and a top, wherein the bottom extends between the first and second sides at the bottom of the building opening, and wherein the top extends between the first and second sides at the top of the building opening, the fenestration system comprising:

a head track extending from a first end to a second end, the head track attached to the top of the building opening between the first and second sides of the building opening, wherein the first and second ends of the head track are configured to move towards and away from the bottom of the building opening with the top of the building opening, wherein the head track comprises a guide rail projecting downward away from the top of the building opening, and wherein the guide rail comprises an inner guide rail surface and an outer guide rail surface located on an opposite side of the guide rail from the inner guide rail surface, and further wherein the guide rail moves with the head track towards and away from the bottom of the building opening with the top of the building opening;

a sliding panel configured for sliding movement between the first end and the second end of the head track along a direction defined by the guide rail of the head track, wherein the sliding panel comprises a frame that comprises a first stile, a second stile, a bottom rail, and a top rail, wherein the top rail extends between a top end of the first stile and a top end of the second stile, and wherein the bottom rail extends between a bottom end of the first stile and a bottom end of the second stile;

a guide channel in the top rail of the sliding panel, wherein the guide channel comprises an inner channel surface and an outer channel surface, wherein the inner channel surface faces the outer channel surface across the guide channel, wherein at least a portion of the guide rail of the head track is located in the guide channel when the sliding panel is assembled with the head track in the building opening, and wherein the inner channel surface faces the inner guide rail surface and the outer channel surface faces the outer guide rail surface, and further wherein the guide rail on the head track moves within the guide channel when the head track moves towards and away from the bottom of the opening;

a lift mechanism operably connected to the sliding panel, wherein the lift mechanism is configured to raise the sliding panel from a lowered configuration to a raised configuration, wherein the top rail of the sliding panel moves towards the head track when moving from the lowered configuration to the raised configuration; and a guide channel seal assembly located in the guide channel between the guide rail and the guide channel, wherein the guide channel seal assembly forms a seal in the guide channel when the sliding panel is in both the raised and lowered configurations, wherein the guide channel seal assembly comprises an inner seal between the inner guide rail surface and the inner channel surface and an outer seal between the outer guide rail surface and the outer channel surface;

a first sliding seal assembly attached to the first stile proximate the top rail of the sliding panel, wherein the first sliding seal assembly comprises a sliding guide and a biasing member operably connected to the sliding guiding, wherein the biasing member is configured to bias the sliding guide against the guide rail of the head track, and wherein the sliding guide is movable along the first stile such that the sliding guide maintains contact with the guide rail of the head track as a distance between the top rail of the sliding panel and the head track changes; and a second sliding seal assembly attached to the second stile proximate the top rail of the sliding panel, wherein the second sliding seal assembly comprises a second sliding guide and a second biasing member operably connected to the second sliding guiding, wherein the second biasing member is configured to bias the second sliding guide against the guide rail of the head track, and wherein the second sliding guide is movable along the second stile such that the second sliding guide maintains contact with the guide rail of the head track as a distance between the top rail of the sliding panel and the head track changes.

20. A sliding fenestration system configured for installation in a building opening that includes a bottom, first and second sides, and a top, wherein the bottom extends between the first and second sides at the bottom of the building opening, and wherein the top extends between the first and second sides at the top of the building opening, the fenestration system comprising:

a head track extending from a first end to a second end, the head track configured for attachment to the top of building opening between the first and second sides of the building opening, wherein the first and second ends of the head track are configured to move towards and away from the bottom of the building opening with the top of the building opening, wherein the head track comprises a guide rail projecting downward away from the top of the building opening, and wherein the guide rail comprises an inner guide rail surface and an outer guide rail surface located on an opposite side of the guide rail from the inner guide rail surface;

a sliding panel configured for sliding movement between the first end and the second end of the head track along a direction defined by the guide rail of the head track, wherein the sliding panel comprises a frame that comprises a first stile, a second stile, a bottom rail, and a top rail, wherein the top rail extends between a top end of the first stile and a top end of the second stile, and wherein the bottom rail extends between a bottom end of the first stile and a bottom end of the second stile;

a guide channel in the top rail of the sliding panel, wherein the guide channel comprises an inner channel surface and an outer channel surface, wherein the inner channel surface faces the outer channel surface across the guide channel, wherein at least a portion of the guide rail of the head track is located in the guide channel when the sliding panel is assembled with the head track in the building opening, and wherein the inner channel surface faces the inner guide rail surface and the outer channel surface faces the outer guide rail surface;

a first side jamb comprising a top end and a bottom end, wherein the first end of the head track is located closer to the top end of the first side jamb than the bottom end of the first side jamb when the head track is positioned along the top of the building opening and the first side jamb is positioned along the first side of the building opening, and wherein the first end of the head track is configured to move along the first side jamb along a first axis extending between the top and bottom ends of the first side jamb; and a first head track slide assembly proximate a junction of the first end of the head track and the first side jamb, wherein first head track slide assembly forms a first head track end seal between the first end of the head track and the first side jamb as the first end of the head track moves along the first axis, and wherein the first head track slide assembly comprises a first slide block at the first end of the head track, wherein the first slide block moves within a first alignment channel in the first side jamb as the first end of the head track moves along the first axis.

21. A fenestration system according to claim 20, the fenestration system comprising:

a second side jamb comprising a top end and a bottom end, wherein the second end of the head track is located closer to the top end of the second side jamb than the bottom end of the second side jamb when the head track is positioned along the top of the building opening and the second side jamb is positioned along the second side of the building opening, and wherein the second end of the head track is configured to move along a second axis extending along the second side jamb between the top and bottom ends of the second side jamb when the head track is attached to the header of the building opening and the second side jamb is attached to the second side of the building opening; and a second head track slide assembly proximate a junction of the second end of the head track and the second side jamb, wherein second head track slide assembly forms a second head track end seal between the second end of the head track and the second side jamb as the second end of the head track moves along the second axis.

22. A fenestration system according to claim 20, the fenestration system comprising:

a second side jamb comprising a top end and a bottom end, wherein the second end of the head track is located closer to the top end of the second side jamb than the bottom end of the second side jamb when the head track is positioned along the top of the building opening and the second side jamb is positioned along the second side of the building opening, and wherein the second end of the head track is configured to move along a second axis extending along the second side jamb between the top and bottom ends of the second side jamb when the head track is attached to the header of the building opening and the second side jamb is attached to the second side of the building opening; and a second head track slide assembly proximate a junction of the second end of the head track and the second side jamb, wherein second head track slide assembly forms a second head track end seal between the second end of the head track and the second side jamb as the second end of the head track moves along the second axis, wherein the second head track slide assembly comprises a second slide block at the second end of the head track, wherein the second slide block moves within a second alignment channel in the second side jamb as the second end of the head track moves along the second axis.

23. A fenestration system according to claim 20, the system further comprising:

a lift mechanism operably connected to the sliding panel, wherein the lift mechanism is configured to raise the sliding panel from a lowered configuration to a raised configuration, wherein the top rail of the sliding panel moves towards the head track when moving from the lowered configuration to the raised configuration; and a guide channel seal assembly located in the guide channel between the guide rail and the guide channel, wherein the guide channel seal assembly forms a seal in the guide channel when the sliding panel is in both the raised and lowered configurations.

24. A fenestration system according to claim 20, wherein the sliding panel further comprises a first sliding seal assembly attached to the first stile proximate the top rail of the sliding panel, wherein the first sliding seal assembly comprises a sliding guide and a biasing member operably connected to the sliding guiding, wherein the biasing member is configured to bias the sliding guide against the guide rail of the head track, and wherein the sliding guide is movable along the first stile such that the sliding guide maintains contact with the guide rail of the head track as a distance between the top rail of the sliding panel and the head track changes.

25. A fenestration system according to claim 24, wherein the sliding panel is movable along the guide rail of the head track into and out of a closed position, wherein the sliding guide of the first sliding seal assembly is aligned with a guide rail seal attached to the guide rail when the sliding panel is in the closed position, wherein the sliding guide and the guide rail seal form a seal when aligned with each other.

* * * * *